US006886537B2

(12) United States Patent
Kondo

(10) Patent No.: US 6,886,537 B2
(45) Date of Patent: May 3, 2005

(54) ACCUMULATION TYPE FUEL INJECTION SYSTEM FOR ENGINE

(75) Inventor: Jun Kondo, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/610,693

(22) Filed: Jul. 2, 2003

(65) Prior Publication Data

US 2004/0003795 A1 Jan. 8, 2004

(30) Foreign Application Priority Data

Jul. 4, 2002 (JP) ..... 2002-196108
Feb. 7, 2003 (JP) ..... 2003-030906

(51) Int. Cl.[7] ..... F02M 37/04
(52) U.S. Cl. ..... 123/468; 123/456
(58) Field of Search ..... 123/470, 456, 123/469, 468

(56) References Cited

U.S. PATENT DOCUMENTS

| | | | | |
|---|---|---|---|---|
| 5,775,302 A | | 7/1998 | Juergen et al. | |
| 6,463,909 B2 | * | 10/2002 | Asada et al. | 123/456 |
| 6,494,183 B2 | * | 12/2002 | Usui et al. | 123/456 |
| 6,609,502 B1 | * | 8/2003 | Frank | 123/469 |
| 6,736,431 B2 | * | 5/2004 | Jung et al. | 285/288.1 |

FOREIGN PATENT DOCUMENTS

| | | | |
|---|---|---|---|
| DE | 4030486 A1 | | 4/1991 |
| DE | 0866221 A1 | | 12/1997 |
| DE | 19945316 A1 | | 4/2001 |
| DE | 1260704 A1 | | 5/2002 |
| DE | 10128715 A1 | | 11/2002 |
| EP | 1162364 A1 | | 12/2001 |
| JP | 4-66769 | | 3/1992 |
| JP | 10-259772 | | 9/1998 |
| JP | 2001-82663 | | 3/2001 |
| WO | 01/09506 | * | 2/2001 |

OTHER PUBLICATIONS

Patent Abstracts of Japan, vol. 1999, No. 13, Nov. 30, 1999, & JP 11 230438A.

* cited by examiner

*Primary Examiner*—Carl S. Miller
(74) *Attorney, Agent, or Firm*—Nixon & Vanderhye PC

(57) ABSTRACT

In an accumulation type fuel injection system for an internal combustion engine, a common rail is formed with an accumulation chamber inside a peripheral wall portion so that a central axis of the accumulation chamber is deviated from that of the common rail, which has a cross section in a complete round shape. Thus, a thick wall portion having thicker wall than other portion of the peripheral wall portion is formed in the peripheral wall portion. A plurality of pipe connecting portions is formed radially inside the thick wall portion. A plurality of pipe connectors is formed separately from the common rail and is connected to the common rail at the pipe connecting portions. As a result, machining of an outer periphery of the common rail is simplified.

9 Claims, 11 Drawing Sheets

ACCUMULATION TYPE FUEL INJECTION SYSTEM FOR ENGINE

CROSS REFERENCE TO RELATED APPLICATION

This application is based on and incorporates herein by reference Japanese Patent Application No. 2002-196108 filed on Jul. 4, 2002 and Japanese Patent Application No. 2003-30906 filed on Feb. 7, 2003.

BACKGROUND OF THE INVENTION

1. Field of the Invention

The present invention relates to an accumulation type fuel injection system for supplying high-pressure fuel accumulated in a common rail into cylinders of an internal combustion engine by injection performed by fuel injection valves. Specifically, the present invention relates to a structure for assembling a pipe connector formed separately from the common rail to a pipe connecting portion of the common rail.

The present invention also relates to a connection structure for connecting a fuel pipe with the common rail.

2. Description of Related Art

Conventionally, in an accumulation type fuel injection system known as a fuel injection system for a diesel engine, a fuel supply pump pressurizes fuel and pressure-feeds the pressurized fuel to a common rail. The common rail accumulates the high-pressure fuel. The high-pressure fuel accumulated in the common rail is distributed to a plurality of electromagnetic fuel injection valves (injectors) connected to downstream ends of high-pressure pipes branching from the common rail. Then, the high-pressure fuel is supplied by injection from the injectors of respective cylinders into the respective cylinders of the engine.

In this case, as shown in FIGS. 12 and 13, a common rail 200 used in the conventional accumulation type fuel injection system is formed with an accumulation chamber 201 for accumulating the high-pressure fuel. The common rail 200 is formed with a fuel passage hole 202 in a lower side of the accumulation chamber 201 in FIG. 12 in a radial direction substantially perpendicular to an axial direction of the accumulation chamber 201. The common rail 200 is formed with a plurality of fuel passage holes 203 formed in an upper side of the accumulation chamber 201 in FIG. 12 in the radial direction substantially perpendicular to the axial direction of the accumulation chamber 201. An accumulator main body 204 of the common rail 200 is integrated with a pipe connecting portion 205 for connecting the common rail 200 with a high-pressure pipe, which is connected to a fuel supply pump. The accumulator main body 204 is integrated with a plurality of pipe connecting portions 206 for connecting the common rail 200 with high-pressure pipes, which are connected to injectors of respective cylinders.

In a manufacturing process of the common rail 200 used in the conventional accumulation type fuel injection system, first, a material with a low degree of hardness such as low-carbon steel is put into forging dies comprising a pair of an upper die and a lower die engraved with a predetermined shape, and is pressurized. Thus, a forged product having a complete round cylinder portion with a cross section in the shape of a complete round and a plurality of pipe connecting portions integrated with the complete round cylinder portion is formed. Then, the accumulation chamber 201 having a cross section in the shape of a complete round is formed in the accumulator main body 204 by using a cutting tool such as a drill and by combining rotational machining movement and linear feeding movement in an axial direction of the rotational machining movement.

Then, the fuel passage holes 202, 203 having cross sections in the shape of a complete round are formed in the pipe connecting portions 205, 206 respectively by using a machining tool such as a drill and by combining the rotational machining movement and the linear feeding movement in the axial direction of the rotational machining movement. Further, a pressure receiving seat surface 221 is formed at an end of the pipe connecting portion 205 by machining the end of an inner periphery of the fuel passage hole 202 so that an internal diameter of the pressure receiving seat surface 221 is gradually increased outward. Likewise, a pressure receiving seat surface 222 is formed at an end of each pipe connecting portion 206 by machining the end of an inner periphery of the fuel passage hole 203 so that an internal diameter of the pressure receiving seat surface 222 is gradually increased outward. Flange-shaped connection heads formed at ends of the high-pressure pipes adhere to the pressure receiving seat surfaces 221, 222 respectively.

Then, fastening portions 207, 208 are formed by machining outer peripheral surfaces of the ends of the pipe connecting portions 205, 206 with a screwing tool. Thus, the accumulator main body 204 having the cross section in the shape of a complete round and the pipe connecting portions 205, 206 respectively having the cross section in the shape of a complete round are formed by machining the forged product in the predetermined shape as shown in FIGS. 12 and 13. As a result, the cost is increased due to a difficulty in the machining of the outer periphery.

Therefore, a method of forming pipe connectors separately from a common rail, and connecting the pipe connectors to the common rail has been proposed, for instance, in JP-A-10-259772 (pages 3–5, FIG. 2) and JP-A-2001-82663 (page 3, FIG. 1).

In the case where the common rail and the pipe connectors are formed separately, as shown in FIG. 14A, a seal surface 303 at an end of a fuel pipe 302 is liquid-tightly fitted to a pressure receiving seat surface 304 provided at a common rail 301. A fuel passage 307 of the fuel pipe 302 is connected with an accumulation chamber 305 of the common rail 301 via a communication hole 306 intersecting with the accumulation chamber 305. The fuel is accumulated in the accumulation chamber 305 at ultra high pressure of 200 MPa. Therefore, it is required to ensure strength at an intersecting portion between the communication hole 306 and the accumulation chamber 305, while ensuring a machining margin for the pressure receiving seat surface 304. Therefore, a great wall thickness "B" is needed at the intersecting portion of the communication hole 306 and the accumulation chamber 305. Further, sufficient strength is needed also in a connection between a pipe connector 308 and the common rail 301. Therefore, a bonding surface 309 between the pipe connector 308 and the common rail 301 is required to have an area "C" capable of ensuring the strength. As a result, a size "A" of the common rail 301 will be enlarged, that is, an external diameter of the common rail 301 will be increased.

In another proposed method, a connecting surface 404 where a pipe connector 403 is connected to a common rail 401 is deeply machined in order to inhibit the increase in the size of the common rail 401 as shown in FIG. 14B. In this case, a wall thickness "B" of the common rail 401 is increased only at a neighborhood of a pressure receiving seat surface 402, and a bonding area "C" between a bonding surface 404 and the pipe connector 403 is ensured as shown by FIG. 14B. However, in such a method, machining cost is increased.

SUMMARY OF THE INVENTION

It is therefore an object of the present invention to provide an accumulation type fuel injection system in which machining of an outer periphery of a common rail is simplified due to a simple shape of an outer peripheral surface of the common rail, so that manufacturing cost can be reduced.

It is therefore another object of the present invention to provide a common rail capable of ensuring an area for connecting a pipe connector thereto and reducing machining cost without enlarging a size of the common rail.

According to an aspect of the present invention, a pipe connecting portion is provided at a peripheral wall surface of an accumulation chamber of a common rail or between an inner peripheral surface and an outer peripheral surface of a peripheral wall portion of the common rail. An outer periphery of a pipe connector is fastened to a fastening portion provided in an inner periphery of the pipe connecting portion. Thus, the outer peripheral surface of the peripheral wall portion provided around the accumulation chamber can be formed in a simple shape having a cross section substantially in the form of a complete round.

Thus, the shape of the outer peripheral surface of the common rail (peripheral wall portion) can be formed only by shaping the accumulation chamber through a round bar material, which is formed in the shape of a complete round cylinder having a cross section substantially in the shape of a complete round, in an axial direction and by shaping pipe connecting portions in the round bar material. Therefore, manufacturing cost can be reduced since machining of an outer periphery of the round bar material is not required.

According to another aspect of the present invention, an accumulation type fuel injection system has a common rail connected with a plurality of fuel pipes through pipe connectors, and the common rail is formed with an accumulation chamber so that a central axis of the accumulation chamber is deviated from a central axis of the common rail. A flat surface is formed at an outer periphery of a thick wall portion, whose wall thickness is increased by deviating the central axis of the accumulation chamber. Ends of the pipe connectors are bonded to the flat surface.

Thus, the thick wall portion ensures strength of an intersecting portion between a communication hole and the accumulation chamber and ensures a machining margin for a pressure receiving seat surface. In addition, the flat surface provided at the outer periphery of the thick wall portion ensures an area for bonding the pipe connectors to the common rail sufficiently. Thus, the machining cost can be reduced while maintaining a size of the common rail at a conventional size, since it is not required to deeply machine a bonding surface of the common rail.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS (First Embodiment)

Figure 1:
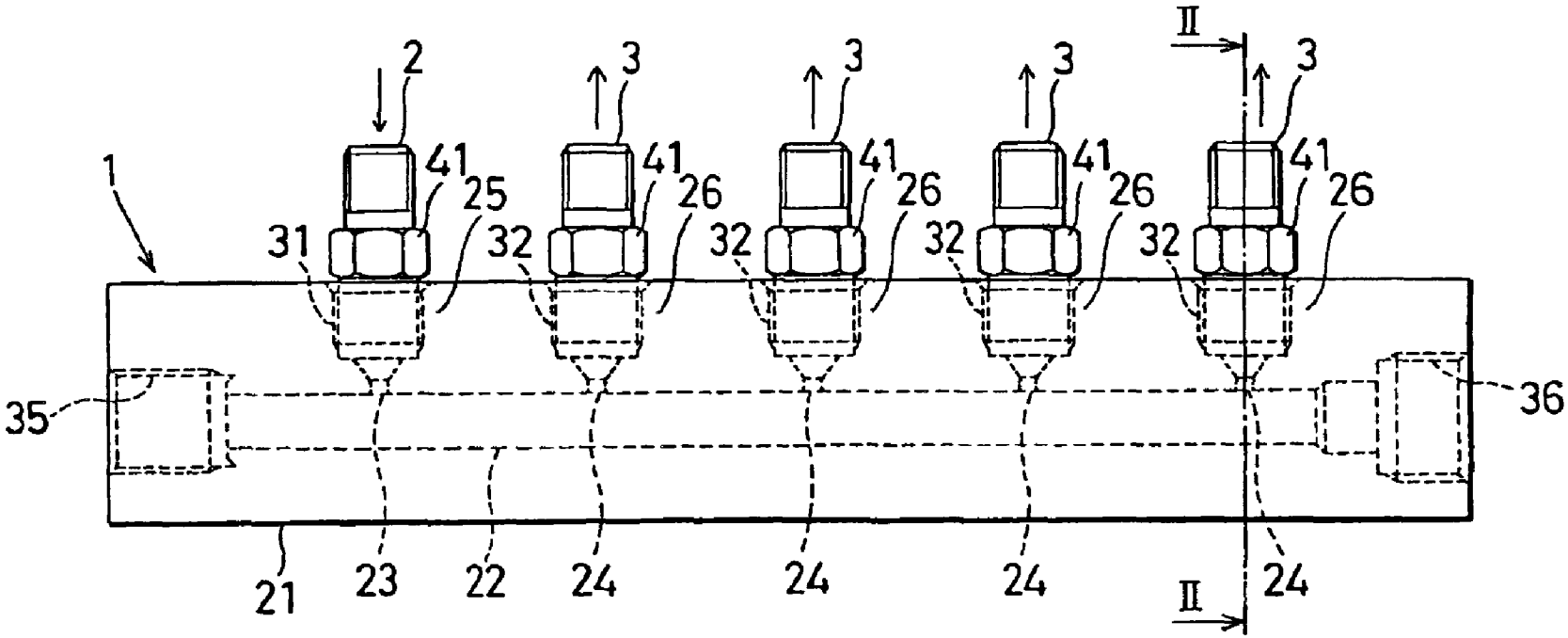
FIG. 1 is a front view showing a common rail used in a common rail type fuel injection system according to a first embodiment of the present invention.

Referring to FIG. 1, a common rail type fuel injection system for an internal combustion engine according to the first embodiment is illustrated. The common rail type fuel injection system of the first embodiment accumulates high-pressure fuel, which is pressurized and pressure-fed by a fuel supply pump, in a common rail 1. The fuel accumulated in the common rail 1 is supplied to injectors (for instance, electromagnetic type fuel injection valves) mounted in respective cylinders of an internal combustion engine such as a 4-cylinder diesel engine mounted in a vehicle such as an automobile. Each injector injects the high-pressure fuel into the cylinder at predetermined injection timing.

The common rail 1 is required to continuously accumulate high pressure corresponding to fuel injection pressure. Therefore, the high-pressure fuel is supplied from the supply pump to the common rail 1 via a high-pressure pipe 11. The high-pressure fuel accumulated in the common rail 1 is distributed to the injectors of the respective cylinders via a plurality of high-pressure pipes 12.

A fuel pressure sensor for outputting a pressure signal corresponding to fuel pressure inside the common rail 1 (common rail pressure) is liquid-tightly press-fitted to a left end of the common rail 1 in FIG. 1. A pressure limiter is liquid-tightly press-fitted to a right end of the common rail 1 in FIG. 1 in order to prevent the common rail pressure from exceeding a limit set pressure by relieving the pressure in the common rail 1. Instead of the pressure limiter, a pressure-reducing regulation valve for reducing the common rail pressure may be employed.

An end of the high-pressure pipe 11 is connected to a pipe connector formed separately from the common rail 1 and the other end of the high-pressure pipe 11 is connected to a pipe connecting portion of the supply pump. A fuel passage for introducing the fuel from the supply pump into the common rail 1 is provided inside the high-pressure pipe 11. The one end of the high-pressure pipe 11 is formed with a connection head portion 11*a* formed in a flange-like shape having an external diameter larger than that of the other portion of the high-pressure pipe 11. A seal surface of the connection head portion 11*a* formed substantially in the shape of a truncated cone is metal-sealed with a pressure receiving seat surface 14 of a connector main body 2.

An end of each high-pressure pipe 12 is connected to a pipe connector formed separately from the common rail 1 and the other end of the high-pressure pipe 12 is connected to a pipe connecting portion of the injector of the cylinder. Each high-pressure pipe 12 is provided with a fuel passage for introducing the fuel from the common rail 1 into the injector, for instance, into a fuel passage, a fuel sump and a pressure control chamber formed inside the injector. The one end of each high-pressure pipe 12 is formed with a connection head portion 12*a* in a flange-like shape having an external diameter larger than that of the other portion of the high-pressure pipe 12. Seal surface of the connection head portion 12*a* formed substantially in the shape of a truncated cone is metal-sealed with a pressure receiving seat surface 15 of a connector main body 3.

The common rail 1 of the embodiment is provided with a peripheral wall portion 21, an accumulation chamber 22, and a plurality of pipe connecting portions 25, 26. The peripheral wall portion 21 is formed with a forged product or a press-molded product made of a material with a low degree of hardness such as low carbon steel. An outer peripheral surface of the peripheral wall portion 21 has a cross section in the shape of a complete round. The accumulation chamber 22 is formed through the peripheral wall portion 21 in its axial direction. The accumulation chamber 22 temporarily accumulates the high-pressure fuel. The plurality of the pipe connecting portions 25, 26 is formed in the peripheral wall portion 21. A branch hole 23 is formed in the peripheral wall portion 21 inside the pipe connecting portion 25 in a radial direction of the peripheral wall portion 21. A plurality of branch holes 24 is formed in the peripheral wall portion 21 respectively inside the pipe connecting portions 26 in the radial direction of the peripheral wall portion 21. The branch holes 23, 24 are arranged at predetermined intervals in the axial direction of the peripheral wall portion 21.

The accumulation chamber 22 is formed by machining an inside of the common rail 1 so that a central axis of the accumulation chamber 22 is deviated from a central axis of the common rail 1. Thus, the accumulation chamber 22 is formed at an eccentric position with respect to an outer periphery of the peripheral wall portion 21. The accumulation chamber 22 is formed by using a machining tool such as a drill and by combining a rotational machining movement and linear feeding movement in an axial direction of the rotational machining movement. The accumulation chamber 22 is formed by drilling the forged product in the axial direction at an eccentric position with respect to the outer periphery. Thus, a thick wall portion is formed in the peripheral wall portion 21. The thick wall portion has a thicker wall in a radial direction than the other portion of the peripheral wall portion 21. The pipe connecting portions 25, 26 are formed at the thick wall portion. A left side surface or a right side surface of the peripheral wall portion 21 of the accumulation chamber 22 in FIG. 1 may be cut off by machining an outer periphery, for instance. The branch holes 23, 24 are formed by drilling the forged product in its radial direction by using a machining tool such as a drill and by combining rotational machining movement and linear feeding movement in a direction of an axis of the rotational machining movement.

More specifically, an external diameter $\phi D$ of the common rail 1 is set at 29 millimeters and an internal diameter $\phi d$ of the accumulation chamber 22 is set at 9.5 millimeters, for instance. The central axis of the accumulation chamber 22 is set at a position deviated from the central axis of the cylindrical common rail 1 by 3.5 millimeters. With the deviation, the peripheral wall portion 21 having the wall thickness L of at most 13.25 millimeters is provided between the inner periphery of the accumulation chamber 22 and the outer periphery of the common rail 1. Thus, in the embodiment, a ratio ($L/\phi D$) of the wall thickness L to the diameter $\phi D$ is set to about 0.45.

The branch hole 23 of the pipe connecting portion 25 provides an inlet side fuel hole (fuel supply passage) for introducing the fuel from the high-pressure pipe 11 in the supply pump side into the accumulation chamber 22. The branch holes 24 of the four pipe connecting portions 26 provide outlet side fuel holes (fuel distribution passages) for discharging the fuel from the accumulation chamber 22 to the high-pressure pipes 12 in the respective injector sides. A fitting hole 31 is formed outside the branch hole 23 in the radial direction of the common rail 1. A plurality of fitting holes 32 is formed respectively outside the branch holes 24 in the radial direction of the common rail 1. The connector main body 2 to be connected with the high-pressure pipe 11 in the supply pump side is fitted to the fitting hole 31. The connector main bodies 3 to be respectively connected with the high-pressure pipes 12 in the injector sides are fitted to the fitting holes 32 respectively. Inner peripheries of the fitting holes 31, 32 are respectively formed with fastening portions 33, 34 in the shape of a female screw to be fastened with outer peripheries of the connector main bodies 2, 3 respectively.

Figure 2:
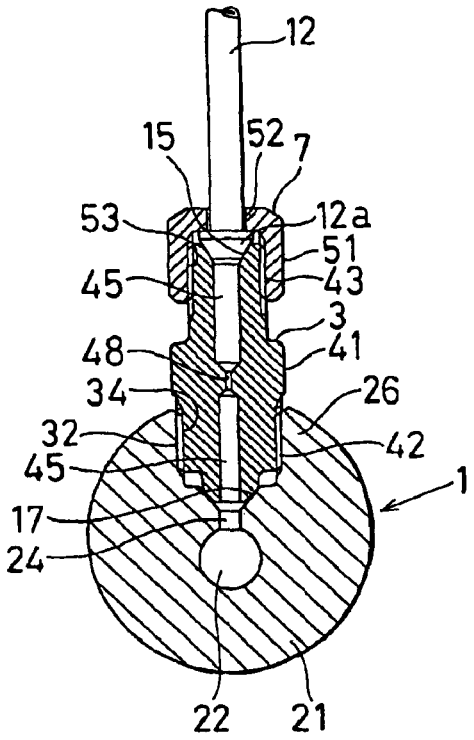
FIG. 2 is a cross-sectional view showing the common rail according to the first embodiment along a line II—II in FIG. 1.
Figure 3:
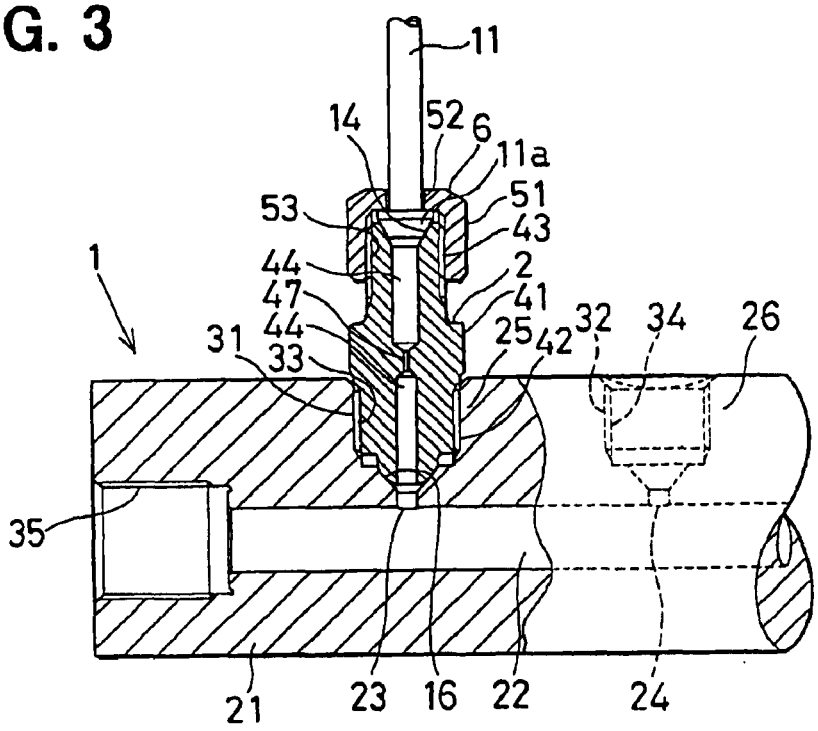
FIG. 3 is a longitudinal cross-sectional view showing an essential structure of the common rail according to the first embodiment.
Figure 4A:
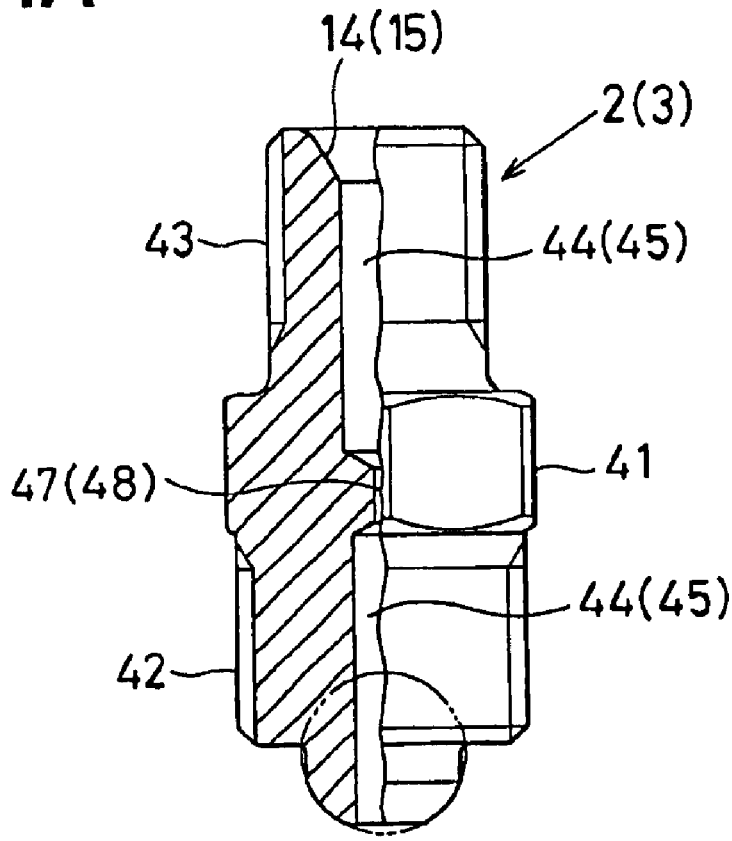
FIG. 4A is a half cross-sectional view showing a connector main body formed separately from the common rail according to the first embodiment.
Figure 4B:
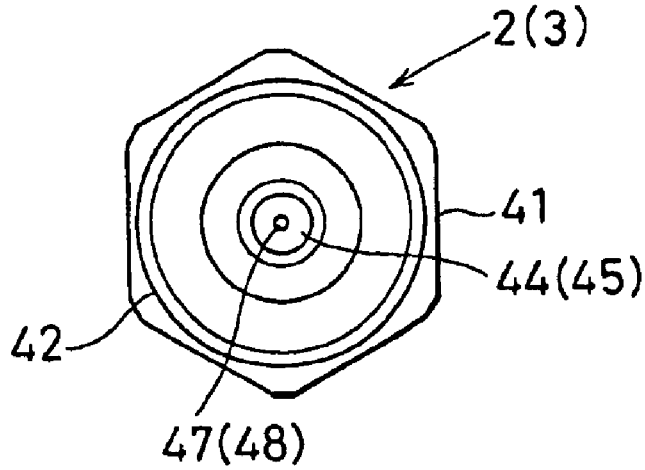
FIG. 4B is a front view showing the connector main body according to the first embodiment.

As shown in FIG. 2, a pressure receiving seat surface 17 is formed substantially in the shape of a cone between the branch hole 24 and the fitting hole 32. As shown in FIG. 3, a pressure receiving seat surface 16 is formed substantially in the shape of a cone between the branch hole 23 and the fitting hole 31. The pressure receiving seat surfaces 16, 17 are formed by machining so that internal diameters thereof gradually increase outward (upward in FIGS. 2 and 3). Adhesion surfaces provided on the connector main bodies 2, 3 adhere to the pressure receiving seat surfaces 16, 17 respectively. A left end of the accumulation chamber 22 in FIG. 1 is formed with a fastening portion 35 in the shape of a female screw to be fastened to a fastened portion in the shape of a male screw formed on an outer periphery of a sensor housing of the fuel pressure sensor. A right end of the accumulation chamber 22 in FIG. 1 is formed with a fastening portion 36 in the shape of a female screw to be fastened to a fastened portion in the shape of a male screw formed on an outer periphery of a housing of the pressure limiter.

Next, the pipe connectors of the embodiment will be explained based on FIGS. 1 to 4B. As shown in FIGS. 2 and 3, the pipe connectors of the embodiment are constituted with the connector main bodies 2, 3 and a plurality of nuts 6, 7. The connector main bodies 2, 3 are formed with a steel material in the form of single pieces respectively, substantially in the same shape of a cylindrical pipe. The nuts 6, 7 are formed with a steel material in the form of single pieces respectively, substantially in the same cylindrical shape.

The connector main bodies 2, 3 are fastening members formed substantially in the shape of a nipple for making the adhesion surfaces of the connector main bodies 2, 3 adhere to the pressure receiving seat surfaces 16, 17, which are formed outside the branch holes 23, 24 in the radial direction of the common rail 1, with predetermined fastening axial force. Outer peripheries of the connector main bodies 2, 3 are formed with hexagonal portions 41 for engaging with an assembling tool. The pressure receiving seat surfaces 14, 15 are formed on the end surfaces of the connector main bodies 2, 3 opposite from the common rail 1 by machining or grinding. The pressure receiving surfaces 14, 15 are formed substantially in conical shapes so that the internal diameters thereof are gradually increased outward. The pressure receiving surfaces 14, 15 are formed so that the seal surfaces of the connection head portions 11*a*, 12*a* provided at the ends of the high-pressure pipes 11, 12 adhere to the pressure receiving surfaces 14, 15. The end surfaces of the connector main bodies 2, 3 are formed with adhesion surfaces by grinding. The adhesion surfaces are formed in the shapes corresponding to the pressure receiving seat surfaces 16, 17. For instance, the adhesion surfaces of the connector main bodies 2, 3 are formed with a curvature centering on substantial central lines of the connector main bodies 2, 3, as shown by a chain double-dashed line in FIG. 4A.

Fastened portions 42 with male screws are formed on outer peripheries of the ends of the connector main bodies 2, 3 in the common rail 1 side respectively. The fastened portions 42 are fastened with respective fastening portions 33, 34 formed on inner peripheries of the pipe connecting portions 25, 26 of the common rail 1. Nut fastening portions 43 with male screws are formed at outer peripheries of the ends of the connector main bodies 2, 3 opposite from the common rail 1. The nut fastening portions 43 are fastened with the respective nuts 6, 7 holding the connection head portions 11*a*, 12*a* of the respective high-pressure pipes 11, 12. Fuel passage holes 44, 45 are formed to penetrate the connector main bodies 2, 3 in axial directions of the connector main bodies 2, 3 respectively. Orifices (fixed restrictors) 47, 48 having flow passage diameters smaller than those of the fuel passage holes 44, 45 are formed in the fuel passage holes 44, 45 respectively.

As shown in FIGS. 2 and 3, the nuts 6, 7 are fastening members formed substantially in the shape of a cap nut for making the seal surfaces of the connection head portions 11*a*, 12*a* of the high-pressure pipes 11, 12 adhere to the pressure receiving seat surfaces 14, 15 of the connector main bodies 2, 3 with a predetermined fastening axial force. The nuts 6, 7 are pipe holding means for holding the connection head portions 11*a*, 12*a* of the high-pressure pipes 11, 12. Outer peripheries of lower end portions of the nuts 6, 7 in FIGS. 2 and 3 are provided with hexagonal portions 51 for engaging with an assembling tool. Upper end portions of the nuts 6, 7 in FIGS. 2 and 3 are formed with through holes 52, which penetrate central portions of the nuts 6, 7. Inner peripheries of lower end portions of the nuts 6, 7 in FIGS. 2 and 3 are provided with nut fastened portions 53 with female screws fastened to the nut fastening portions 43 of the connector main bodies 2, 3. The high-pressure pipes 11, 12 are held in the nuts 6, 7 in a state in which the ends of the high-pressure pipes 11, 12 penetrate the through holes 52.

Next, a method of assembling the pipe connectors and the high-pressure pipes 11, 12 to the common rail 1 of the embodiment will be explained based on FIGS. 1 to 4B.

First, the lower end portions of the connector main bodies 2, 3 are fitted into the fitting holes 31, 32 of the common rail 1 from an upper side of the illustration in FIG. 1. Then, the connector main bodies 2, 3 are rotated in a predetermined direction with the assembling tools engaged with the hexagonal portions 41. Thus, the fastened portions 42 of the connector main bodies 2, 3 are screwed to the respective fastening portions 33, 34 formed on the inner peripheries of the pipe connecting portions 25, 26 of the common rail 1. Thus, the connector main bodies 2, 3 are fastened into the fitting holes 31, 32 of the common rail 1.

Thus, the connector main bodies 2, 3 formed separately from the common rail 1 is integrally assembled to the pipe connecting portions 25, 26 provided inside the common rail 1, that is, radially inside the outer peripheral surface of the common rail 1. At this occasion, sealing performance between the common rail 1 and the connector main bodies 2, 3 is ensured by making the adhesion surfaces provided at the end surfaces of the connector main bodies 2, 3 in the common rail 1 side adhere to the pressure receiving seat surfaces 16, 17 respectively in a metal-sealed manner with a predetermined fastening axial force applied by the connector main bodies 2, 3, which are integrated with the common rail 1.

Then, the respective nuts 6, 7 holding the connection head portions 11*a*, 12*a* of the respective high-pressure pipes 11, 12 are fitted to the upper end portions of the connector main bodies 2, 3 from upper sides of the illustration in FIG. 1 by engaging the assembling tools to the hexagonal portions 51 and rotating the nuts 6, 7 in a predetermined direction. Thus, the nut fastened portions 53 of the nuts 6, 7 are fastened to the nut fastening portions 43 of the connector main bodies 2, 3. Thus, the inner peripheries of the nuts 6, 7 are screwed and fastened to the outer peripheries of the upper end portions of the connector main bodies 2, 3 in FIG. 1.

Thus, the nuts 6, 7 and the connection head portions 11*a*, 12*a* of the high-pressure pipes 11, 12 are integrally assembled to the connector main bodies 2, 3. At this occasion, sealing performance between the connection head portions 11*a*, 12*a* and the connector main bodies 2, 3 is ensured by making the seal surfaces of the connection head portions 11*a*, 12*a* adhere to the pressure receiving seat surfaces 14, 15 provided at the upper end surfaces of the connector main bodies 2, 3 in FIG. 1 in a metal-sealed manner with a predetermined fastening axial force applied by the nuts 6, 7, which are integrated to the connector main bodies 2, 3.

Next, a function of the common rail type fuel injection system of the embodiment will be explained based on FIGS. 1 to 3.

The high-pressure fuel discharged from the supply pump flows from a fuel passage formed at the connection head portion 11*a* of the high-pressure pipe 11 into a portion of the fuel passage hole 44 in an upstream side of the connector main body 2 via the high-pressure pipe 11 connected to the pipe connecting portion of the supply pump. The high-pressure fuel flowing into the upstream portion of fuel passage hole 44 flows into another portion of the fuel passage hole 44 in a downstream side of the connector main body 2 via the orifice 47. The high-pressure fuel flowing into the downstream portion of the fuel passage hole 44 flows into the accumulation chamber 22 of the common rail 1 via the branch hole 23 and is temporarily accumulated in the accumulation chamber 22.

For instance, if fuel injection from the injector of a cylinder #1 into the cylinder #1 is started, the high-pressure fuel accumulated in the accumulation chamber 22 of the common rail 1 flows into a portion of the fuel passage hole 45 in the upstream side of the connector main body 3 via the branch hole 24 corresponding to the cylinder #1. The high-pressure fuel flowing into the upstream portion of the fuel passage hole 45 flows into another portion of the fuel passage hole 45 in the downstream side of the connector main body 3 via the orifice 48. Then, the high-pressure fuel is introduced from the pipe connecting portion of the injector of the cylinder #1 into the injector, for instance, into the fuel passage, the fuel sump and the pressure control chamber of the injector, via the fuel passage formed inside the high-pressure pipe 12. The high-pressure fuel accumulated in the accumulation chamber 22 of the common rail 1 is similarly distributed to the injectors of the other cylinders, for instance, into the fuel passages, the fuel sumps and the pressure control chambers of the injectors.

As explained above, the pipe connector connected with the high-pressure pipe 11 in the supply pump side and the pipe connectors connected with the high-pressure pipes 12 in the injectors side are constituted with the small parts, separately from the common rail 1. More specifically, the pipe connectors are constituted with the connector main bodies 2, 3 and the nuts 6, 7. The connector main bodies 2, 3 are formed with a small steel material in the form of single pieces respectively, substantially in the same shape of a cylindrical pipe. The nuts 6, 7 are formed with a steel material in the form of single pieces respectively, substantially in the same cylindrical shape.

The connector main bodies 2, 3 are integrally assembled to the common rail 1 by fitting the connector main bodies 2, 3 into the fitting holes 31, 32 of the common rail 1 and screwing and fastening the fastened portions 42 of the connector main bodies 2, 3 to the respective fastening portions 33, 34 formed at the inner peripheries of the pipe connecting portions 25, 26 of the common rail 1 (first fastening step).

Then, the pipe connectors and the connection head portions 11*a*, 12*a* of the high-pressure pipes 11, 12 can be integrally assembled to the common rail 1 firmly and simply only by fastening the nut fastened portions 53 of the respective nuts 6, 7 holding the connection head portions 11*a*, 12*a* to the nut fastening portions 43 provided at the upper end portions of the connector main bodies 2, 3 in FIG. 1, which are integrated to the common rail 1 (second fastening step). Thus, the assembling operation is simplified and cost performance is improved.

In the case in which the common rail 1 is mounted to an engine having a different number of cylinders, the numbers of the branch holes 23, 24 and the fitting holes 31, 32 of the common rail 1 are changed. Thus, the common rail 1 can be assembled with a plurality of the pipe connectors without changing the shapes of the pipe connectors (the connector main bodies 2, 3 and the nuts 6, 7). Thus, common assembled parts such as the pipe connectors assembled to the common rail 1 can be used in the four-cylinder type common rail and the six-cylinder type common rail, which are used for supplying the high-pressure fuel to injectors mounted on the respective cylinders of the engines having different numbers of cylinders. As a result, the cost is reduced.

In the common rail type fuel injection system of the embodiment, the orifices 47, 48 are formed in the fuel passage holes 44, 45 formed in the connector main bodies 2, 3, which are small parts formed separately from the common rail 1. The orifices 47, 48 are not formed in the common rail 1, which is a large part. Therefore, fine machining or machining of small portions of the orifices 47, 48 can be easily carried out. As a result, the cost is reduced.

The pipe connectors are formed separately from the common rail 1, and the pipe connecting portions 25, 26 are formed inside the peripheral wall portion 21. Therefore, the outer periphery of the common rail 1 of the embodiment including the accumulation chamber 22, the branch holes 23, 24, the fitting holes 31, 32 and the like can be easily formed from the forged product having a cross section in the shape of a simple and substantially complete round. As a result, the machining cost is reduced.

The accumulation chamber 22 of the common rail 1 is formed at the eccentric position with respect to the outer periphery of the peripheral wall portion 21 having a cross section substantially in the shape of a complete round. Therefore, the pipe connecting portions 25, 26 can be formed at the thick wall portion in the peripheral wall portion 21 where the wall is thicker than the other portion of the peripheral wall portion 21. Thus, the same effect as the case where wall thickness is built up to form the pipe connecting portions 25, 26 there can be achieved. As a result, strength of the pipe connecting portions 25, 26 provided inside the peripheral surface of the peripheral wall portion 21 in the radial direction of the common rail 1 can be increased.

The sealing performance between the pressure receiving seat surfaces 16, 17 of the common rail 1 and the adhesion surfaces (seal surfaces) of the connector main bodies 2, 3 can be sufficiently ensured by applying a predetermining fastening axial force with the connector main bodies 2, 3. In addition, the sealing performance between the adhesion surfaces (seal surfaces) of the connection head portions 11*a*, 12*a* and the pressure receiving seat surfaces 14, 15 of the connector main bodies 2, 3 can be sufficiently ensured by applying a predetermined fastening axial force with the nuts 6, 7. Thus, reliability of the high-pressure seal portions constituted with the pipe connecting portions 25, 26 of the common rail 1, the connector main bodies 2, 3 and the connection head portions 11*a*, 12*a* of the high-pressure pipes 11, 12 can be ensured.

(Second embodiment)

Figure 5:
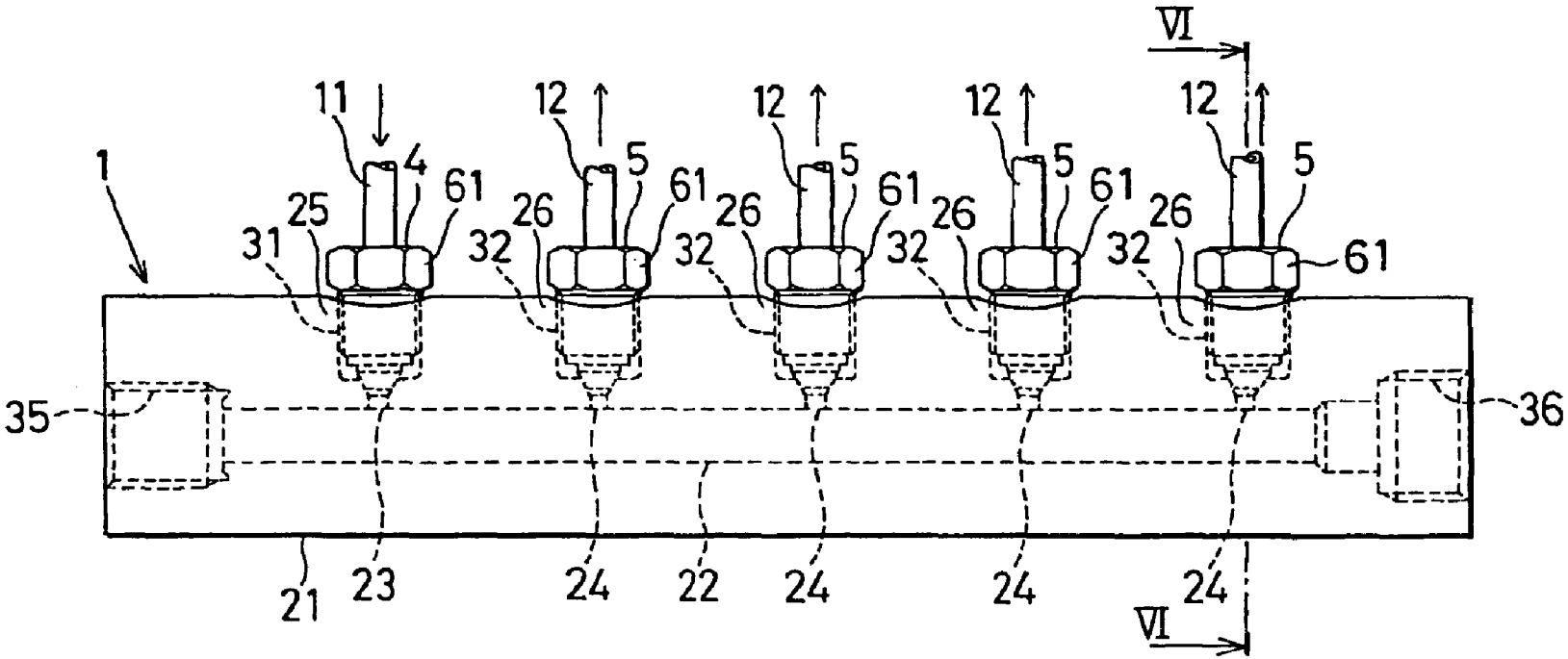
FIG. 5 is a front view showing a common rail used in a common rail type fuel injection system according to a second embodiment of the present invention.

Next, a common rail used in the common rail type fuel injection system according to a second embodiment of the present invention will be explained based on FIGS. 5 to 7.

Figure 6:
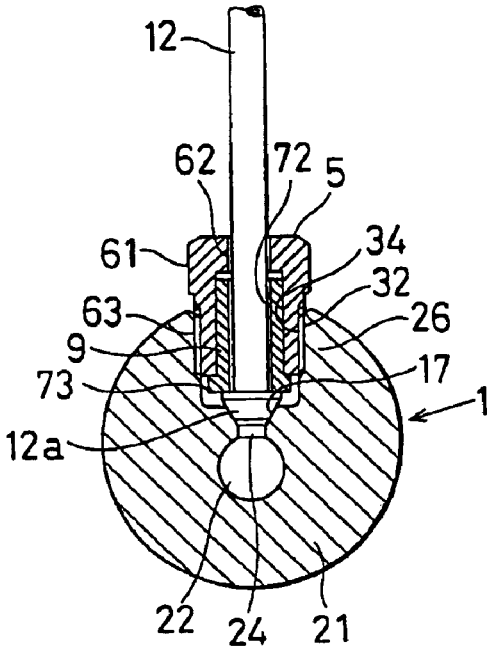
FIG. 6 is a cross-sectional view showing the common rail according to the second embodiment along a line VI—VI in FIG. 5.
Figure 7:
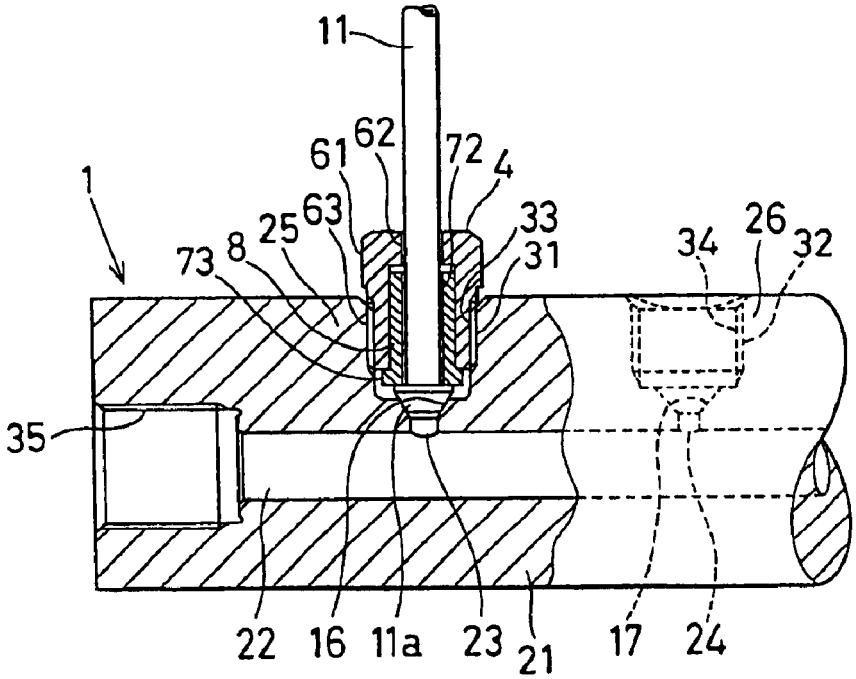
FIG. 7 is a longitudinal cross-sectional view showing an essential structure of the common rail according to the second embodiment.

As shown in FIGS. 6 and 7, a plurality of pipe connectors of the embodiment is constituted with a plurality of connector main bodies 4, 5 and a plurality of sleeves 8, 9. The connector main bodies 4, 5 are formed with a steel material in the form of single pieces respectively, substantially in the same cylindrical shape. The sleeves 8, 9 are formed with a steel material in the form of single pieces respectively, substantially in the same cylindrical shape.

The connector main bodies 4, 5 are fastening members formed substantially in a bag-like shape for making the seal surfaces of the connection head portions 11*a*, 12*a* of the high-pressure pipes 11, 12 adhere to the pressure receiving seat surfaces 16, 17 above the branch holes 23, 24 of the common rail 1 in FIGS. 6 and 7 with a predetermined fastening axial force via the sleeves 8, 9. The connector main bodies 4, 5 serve also as pipe holding means for holding the connection head portions 11*a*, 12*a* of high-pressure pipes 11, 12. Outer peripheries of the upper end portions of the connector main bodies 4, 5 in FIG. 5 are provided with hexagonal portions 61 for engaging with an assembling tool. The upper end portions of the connector main bodies 4, 5 in FIGS. 6 and 7 are formed with through holes 62 so that the through holes 62 penetrate the centers of the connector main bodies 4, 5 respectively. Outer peripheries of the connector main bodies 4, 5 are formed with fastened portions 63 with a male screw shape, which is fastened to the respective fastening portions 33, 34 formed at inner peripheries of the pipe connecting portions 25, 26 of the common rail 1.

The sleeves 8, 9 are contained and held inside the connector main bodies 4, 5 respectively. The sleeves 8, 9 are formed with through holes 72 penetrating central portions of the sleeves 8, 9 respectively. Lower end portions of the sleeves 8, 9 in FIGS. 6 and 7 are formed with pressing portions 73 in the shape of a flange. The pressing portions 73 press the connection head portions 11*a*, 12*a* against the pressure receiving seat surfaces 16, 17 above the branch holes 23, 24 of the common rail 1 in FIGS. 6 and 7. The high-pressure pipes 11, 12 are held in the connector main bodies 4, 5 and the sleeves 8, 9 in a state in which ends of the high-pressure pipes 11, 12 penetrate the through holes 62, 72.

Next, a method of assembling the plurality of pipe connectors and the plurality of high-pressure pipes 11, 12 to the common rail 1 of the embodiment will be explained based on FIGS. 5 to 7.

In the assembling method, first, the respective high-pressure pipes 11, 12 are inserted into the through holes 62, 72. Then, the connector main bodies 4, 5 and the sleeves 8, 9 holding the connection head portions 11*a*, 12*a* are fitted into the fitting holes 31, 32 of the common rail 1 from upper side of illustrations in FIG. 5. Then, the assembling tool is engaged with the hexagonal portions 61 to rotate the connector main bodies 4, 5 in a predetermined direction. Thus, the fastened portions 63 of the connector main bodies 4, 5 are screwed and fastened to the respective fastening portions 33, 34 formed at the inner peripheries of the pipe connecting portions 25, 26 of the common rail 1. Thus, the connector main bodies 4, 5 are screwed and fastened in the fitting holes 31, 32 of the common rail 1.

Thus, the connector main bodies 4, 5 and the connection head portions 11*a*, 12*a* of the high-pressure pipes 11, 12 formed separately from the common rail 1 are integrally assembled to the pipe connecting portions 25, 26, which are formed radially inside the outer peripheral surface of the common rail 1. At this time, the pressing portions 73 of the sleeves 8, 9 press the connection head portions 11*a*, 12*a* to the lower side of the illustration in FIG. 5 with a predetermined fastening axial force applied by the connector main bodies 4, 5, which are integrated to the common rail 1. Therefore, the seal surfaces of the connection head portions 11*a*, 12*a* adhere to the pressure receiving seat surfaces 16, 17, which are provided outside the branch holes 23, 24 in the radial direction of the common rail 1, in a metal-sealed manner. As a result, the sealing performance between the connection head portions 11*a*, 12*a* and the common rail 1 is ensured.

(Third Embodiment)

Next, An accumulation type fuel injection system according to a third embodiment of the present invention will be explained based on FIGS. 8 to 9B.

Figure 8:
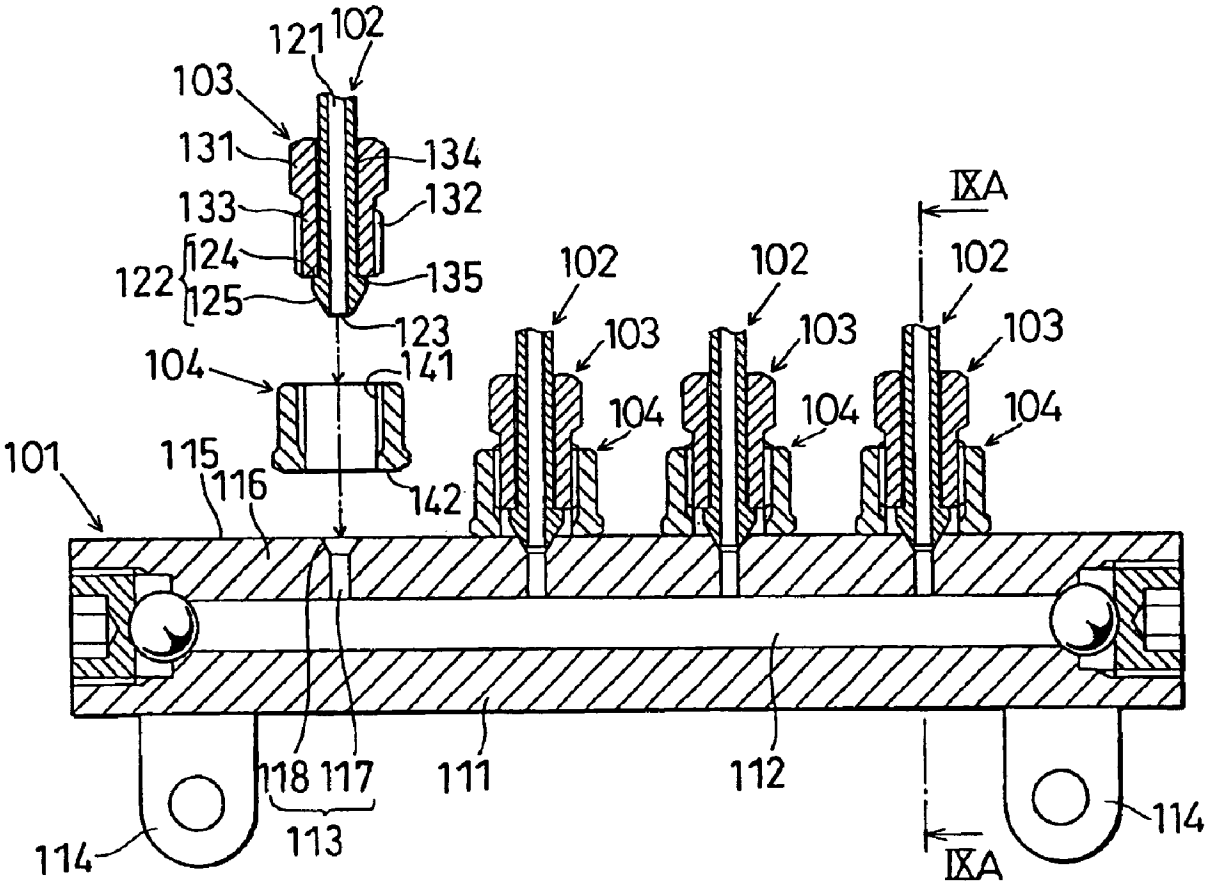
FIG. 8 is a longitudinal cross-sectional view showing a common rail in a state in which a fuel pipe is connected to the common rail according to a third embodiment of the present invention.

As shown in FIG. 8, a common rail 101 is connected with a plurality of fuel pipes 102. The fuel pipe 102 is a pipe for supplying the high-pressure fuel accumulated in the common rail 101 to the respective cylinders. The common rail 101 is also connected with a fuel pipe for receiving the high-pressure fuel pressure-fed from a fuel supply pump, separately from the fuel pipe 102.

A bolt 103 is fastened to a sleeve 104. Thus, the fuel pipe 102 is pressed against the common rail 101 by the bolt 103. Thus, the fuel pipe 102 is connected to the common rail 101.

Left and right ends of the common rail 101 are hermetically closed by screws formed with hexagonal recesses as shown in FIG. 8. When the common rail 101 is mounted to a vehicle, a fuel pressure sensor, a pressure limiter and the like are fastened to the left and right ends of the common rail 101. The fuel pressure sensor outputs a pressure signal corresponding to fuel pressure inside of the common rail 101 (common rail pressure). Fuel injection timing or the like is calculated in accordance with an output value of the fuel pressure sensor. The pressure limiter is used for relieving the high-pressure fuel in the common rail 101 so that the common rail pressure does not exceed limit set pressure. Instead of the pressure limiter, a pressure-reducing regulation valve for reducing the common rail pressure may be employed.

The common rail 101 is provided with a peripheral wall portion 111, an accumulation chamber 112, a communication hole 113, an assembling portion 114 and the like. The peripheral wall portion 111 is a wall portion formed in a partially cylindrical shape. The peripheral wall portion 111 is formed by machining a round bar material having a cross section in the shape of a complete round. The round bar material is fabricated by forging or press-molding a material having a low degree of hardness such as low carbon steel. The peripheral wall portion 111 provides the accumulation chamber 112 inside the peripheral wall portion 111.

The accumulation chamber 112 is formed so that the accumulation chamber 112 penetrates the round bar material in an axial direction. Fuel, which is pressurized and pressure-fed by the fuel supply pump, flows into the accumulation chamber 112. The high-pressure fuel accumulated in the accumulation chamber 112 is supplied to the injectors of the respective cylinders of the internal combustion engine.

Figure 9A:
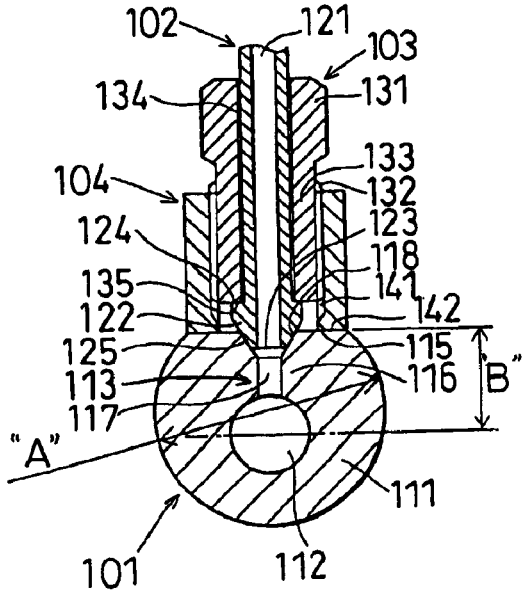
FIG. 9A is a cross-sectional view showing the common rail according to the third embodiment along the line IXA—IXA in FIG. 8.
Figure 9B:
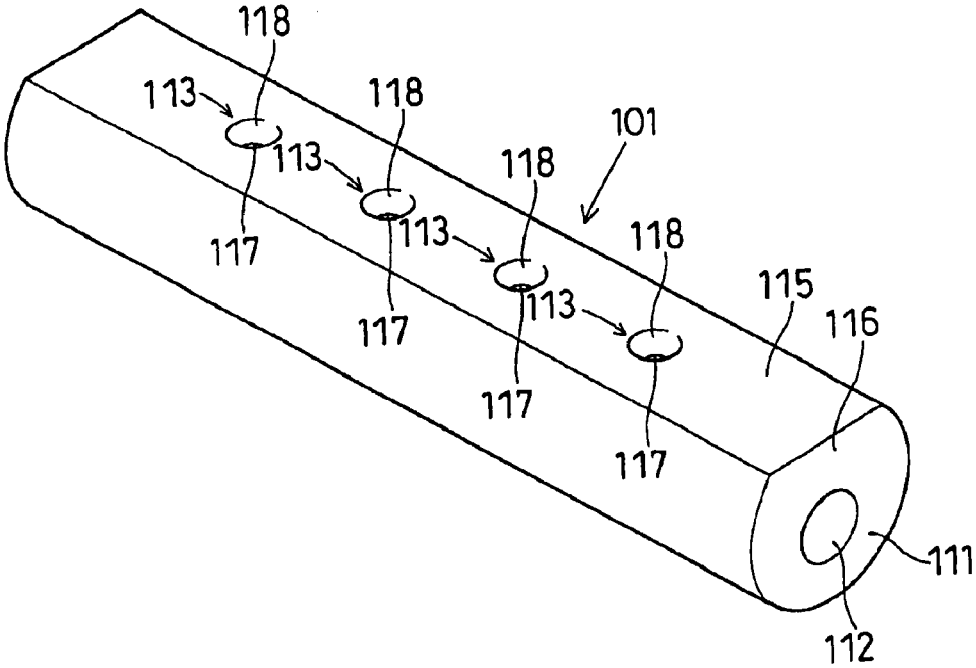
FIG. 9B is a perspective view showing an outline of the common rail according to the third embodiment.

As shown in FIG. 9A, a central axis of the accumulation chamber 112 is deviated from a central axis of the round bar material, or a central axis of the common rail 101. More specifically, the accumulation chamber 112 is formed at an eccentric position with respect to a center of the round shape of the cross section of the round bar material. A machining tool such as a drill is used for forming the accumulation chamber 112. The accumulation chamber 112 is formed by combining rotational machining movement of the machining tool and its linear feeding movement in a direction of an axis of the rotational machining movement.

A plurality of communication holes 113 connects the accumulation chamber 112 with fuel passages 121 of the fuel pipes 102. As shown in FIG. 9B, each communication hole 113 is formed from a flat surface 115 toward the accumulation chamber 112 substantially perpendicularly to the flat surface 115, so that the communication hole 113 intersects the accumulation chamber 112 substantially perpendicularly. The communication hole 113 is formed by combining rotational machining movement of a machining tool such as a drill and its linear feeding movement in an axial direction of the rotational machining movement. The communication hole 113 can be formed also by boring by press working or the like.

The flat surface 115 is provided at an outer periphery of a thick wall portion 116 of the peripheral wall portion 111. The thick wall portion 116 is formed by deviating the central axis of the accumulation chamber 112 from the central axis of the common rail 101 so that the wall thickness of the thick wall portion 116 becomes greater than the other portion of the peripheral wall portion 111. The flat surface 115 is parallel to the central axes of the common rail 101 and the accumulation chamber 112. The flat surface 115 is produced by machining to cut off the outer periphery of the thick wall portion 116 uniformly into a flat shape from one end to the other end of the common rail 101 along the longitudinal direction.

As shown in FIG. 9A, the communication hole 113 includes a cylindrical portion and a conical portion. The cylindrical portion is formed so that its internal diameter is constant from the accumulation chamber 112 to a boundary between the cylindrical portion and the conical portion. The conical portion is formed so that its internal diameter is enlarged in a conical shape from the boundary between the cylindrical portion and the conical portion to the flat surface 115. The cylindrical portion constitutes a fuel passage 117 through which the high-pressure fuel accumulated in the accumulation chamber 112 flows out to the fuel passage 121 of the fuel pipe 102. The conical portion constitutes a pressure receiving seat surface 118, which is fitted with a connection head portion 122 of the fuel pipe 102 liquid-tightly when the fuel pipe 102 is connected to the common rail 101.

The assembling portion 114 is used for inserting a screw or a bolt for fixing the common rail 101 at a predetermined location in the vehicle.

As shown in FIG. 9A, the fuel passage 121 is formed inside the fuel pipe 102. One end of the fuel pipe 102 constitutes the connection head portion 122 fitted to the pressure receiving seat surface 118 of the common rail 101. The other end of the fuel pipe 102 is connected to a pipe connecting portion of the injector of each cylinder.

The fuel passage 121 is a fuel passage for introducing the fuel into a fuel passage, a fuel sump, a pressure control chamber and the like formed inside the injector. The high-pressure fuel accumulated in the accumulation chamber 112 flows through the fuel passage 121. The fuel passage 121 is formed also inside the connection head portion 122. An opening portion 123 of the fuel passage 121 is formed in an end of the connection head portion 122. The opening portion 123 faces the fuel passage 117 of the communication hole 113 when the fuel pipe 102 is connected to the common rail 101.

The connection head portion 122 has a flange-shaped portion, whose external diameter is larger than the external diameter of the other portion of the fuel pipe 102. Meanwhile, the connection head portion 122 has a cone-shaped portion, whose external diameter is reduced toward the end of the connection head portion 122. A substantially ring-shaped upper end surface of the flange-shaped portion of the connection head portion 122 in FIG. 9A provides a pressure receiving seat surface 124. The pressure receiving seat surface 124 is pressed to the common rail 101 side by an end of the bolt 103 when the fuel pipe 102 is connected to the common rail 101. A lower surface of the cone-shaped portion of the connection head portion 122 in FIG. 9A provides a seal surface 125, which is fitted to the pressure receiving seat surface 118 of the common rail 101 liquid-tightly when the fuel pipe 102 is connected to the common rail 101.

The bolt 103 is a pipe connector for connecting the fuel pipe 102 to the common rail 101. Like an ordinary bolt, the bolt 103 has a bolt head portion 131 of a hexagonal head, with which a spanner or the like is engaged to rotate and fasten the bolt 103, and a bolt shaft portion 133, which is provided with a male screw 132. An insertion hole 134 is formed inside the bolt 103 in an axial direction of the bolt head portion 131 and the bolt shaft portion 133. The fuel pipe 102 is inserted to the insertion hole 134 to penetrate the bolt head portion 131 and the bolt shaft portion 133. The male screw 132 is a fastening portion, which is fastened to a female screw 141 of the sleeve 104 when the fuel pipe 102 is connected to the common rail 101. An end surface of the bolt shaft portion 133 is formed with a pressing portion 135. The pressing portion 135 presses the pressure receiving seat surface 124 of the fuel pipe 102 to the common rail 101 side when the fuel pipe 102 is connected to the common rail 101.

The sleeve 104 is a connector formed in a cylindrical shape. If the sleeve 104 is fastened by the bolt 103, the sleeve 104 holds the connection head portion 122 of the fuel pipe 102 and connects the fuel passage 121 of the fuel pipe 102 with the communication hole 113 of the common rail 101. The sleeve 104 is provided with the female screw 141 on its inner peripheral surface. The female screw 141 is a fastened portion, which is fastened with the male screw 132 of the bolt 103 when the fuel pipe 102 is connected to the common rail 101. A bonding surface 142 is formed at an end surface of the sleeve 104. The bonding surface 142 is bonded to the flat surface 115 of the common rail 101.

The bonding surface 142 is a flat surface in the shape of a circular ring. The bonding surface 142 is bonded to the flat surface 115 to surround an opening portion of the communication hole 113 in the flat surface 115 side. The bonding surface 142 and the flat surface 115 are positioned and bonded with each other so that the communication hole 113 communicates with the fuel passage 121 when the bolt 103 is fastened to the sleeve 104 and the fuel pipe 102 is connected to the common rail 101. The flat surface 115 of the common rail 101 and the bonding surface 142 of the sleeve 104 are bonded by ordinary arc welding. More specifically, arc is generated by applying voltage between a welding rod and a base material (the flat surface 115 or the bonding surface 142). The welding rod is melted with heat of the arc and is fused with a portion of the base material to constitute a weld metal. Thus, the base materials, or the flat surface 115 of the common rail 101 and the bonding surface 142 of the sleeve 104, are bonded to each other.

Next, a method of connecting the fuel pipe 102 to the common rail 101 will be explained. The fuel pipe 102 is previously inserted into the insertion hole 134 of the bolt 103 in a direction enabling the pressing portion 135 to contact the pressure receiving seat surface 124 of the connection head portion 122.

First, a bonding position between the common rail 101 and the sleeve 104 is determined and the flat surface 115 of the common rail 101 and the bonding surface 142 of the sleeve 104 are bonded by arc welding. Then, the seal surface 125 of the connection head portion 122 of the fuel pipe 102 is fitted to the pressure receiving seat surface 118 of the common rail 101.

Then, the male screw 132 of the bolt 103, to which the fuel pipe 102 is inserted previously, is fastened with the female screw 141 of the sleeve 104 by applying a tool such as a spanner at the bolt head portion 131 and rotating the bolt 103. Thus, the pressing portion 135 of the bolt 103 is moved toward the common rail 101 in the sleeve 104 and is brought into contact with the pressure receiving seat surface 124 of the connection head portion 122. When the bolt 103 is rotated further, the pressing portion 135 presses the pressure receiving seat surface 124 and the seal surface 125 of the connection head portion 122 is pressed against the pressure receiving seat surface 118 of the common rail 101. Thus, the connection head portion 122 is fitted to the pressure receiving seat surface 118 liquid-tightly.

The high-pressure fuel pressurized and pressure-fed by the fuel supply pump flows into the accumulation chamber 112 of the common rail 101 through a fuel pipe (not shown) and is accumulated in the accumulation chamber 112. At this occasion, when fuel injection from the injector of the cylinder #1 into the cylinder #1 is started for instance, the high-pressure fuel accumulated in the accumulation chamber 112 flows into the fuel passage 121 of the fuel pipe 102 via the communication hole 113 corresponding to the cylinder #1. Then, the high pressure fuel is supplied from a pipe connecting portion of the injector of the cylinder #1 to the fuel passage, the fuel sump, the pressure control chamber and the like formed inside the injector via the fuel passage 121. Likewise, the high-pressure fuel is supplied to the injectors of the other cylinders.

As explained above, in the accumulation type fuel injection system in which the fuel pipe 102 is connected with the common rail 101 by the bolt 103 and the sleeve 104, the accumulation chamber 112 of the common rail 101 is provided so that the central axis of the accumulation chamber 112 is deviated from the central axis of the common rail 101. In addition, the flat surface 115 bonded with the end of the sleeve 104 is formed at the outer periphery of the thick wall portion 116, whose thickness "B" is increased by making the accumulation chamber 112 eccentric with respect to the common rail 101 as shown in FIG. 9A.

The thick wall portion 116 ensures the strength at the intersection between the communication hole 113 and the accumulation chamber 112. In addition, the thick wall portion 116 ensures the machining margin for the pressure receiving seat surface 118, which is fitted with the connection head portion 122 of the fuel pipe 102. Furthermore, the flat surface 115 provided radially outside the thick wall portion 116 ensures an area for bonding the sleeve 104 to the common rail 101. Thus, the area for bonding the sleeve 104 to the common rail 101 can be ensured while maintaining the size "A" of the common rail 101 at the size of the conventional common rail, without increasing the external diameter of the common rail 101 as shown in FIG. 9A. Furthermore, it is not required to deeply machine the bonding surface. Therefore, the machining cost can be reduced.

The sleeve 104 is formed in the cylindrical shape and the end surface of the sleeve 104 is provided with the bonding surface 142, which is bonded to the flat surface 115 of the common rail 101. Therefore, the sleeve 104 can be bonded to the common rail 101 so that the sleeve 104 surrounds the portion for fitting the fuel pipe 102 to the common rail 101.

The bolt 103, which is separate from the sleeve 104, is used for connecting the fuel pipe 102 to the common rail 101. The bolt 103 is formed with the insertion hole 134 for inserting the fuel pipe 102. The bolt 103 can hold the fuel pipe 102 in a state in which the fuel pipe 102 is inserted to the insertion hole 134. The bolt 103 presses the flange-shaped connection head portion 122 provided at the end of the fuel pipe 102 with the pressing portion 135 provided at the end of the bolt 103. Accordingly, the connection head portion 122 is pressed to the common rail 101 side by fastening the bolt 103 to the sleeve 104. Thus, the fuel pipe 102 is connected to the common rail 101 by fastening the bolt 103 to the sleeve 104. Thus, a simple method of fastening the male screw 132 with the female screw 141 can be used as means for connecting the fuel pipe 102 to the common rail 101.

Furthermore, the common rail 101 is provided with the pressure receiving seat surface 118, which is fitted with the connection head portion 122 of the fuel pipe 102 liquid-tightly. Therefore, fuel leak from the connecting portion of the end of the fuel pipe 102 and the communication hole 113 of the common rail 101 can be prevented.

(Fourth Embodiment)

Figure 10A:
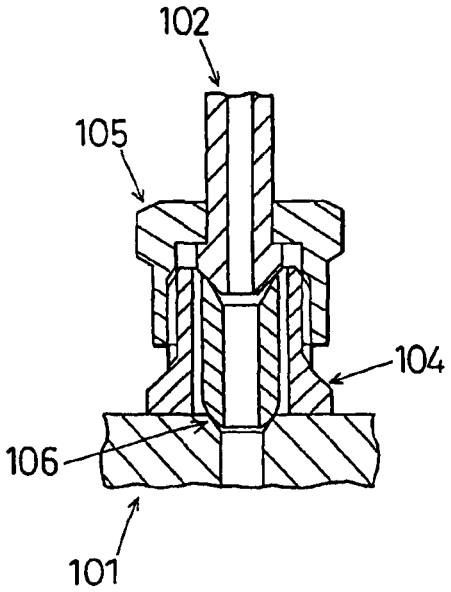
FIG. 10A is a longitudinal cross-sectional view showing a pipe connector in a state after connecting a fuel pipe to a common rail according to a fourth embodiment of the present invention.
Figure 10B:
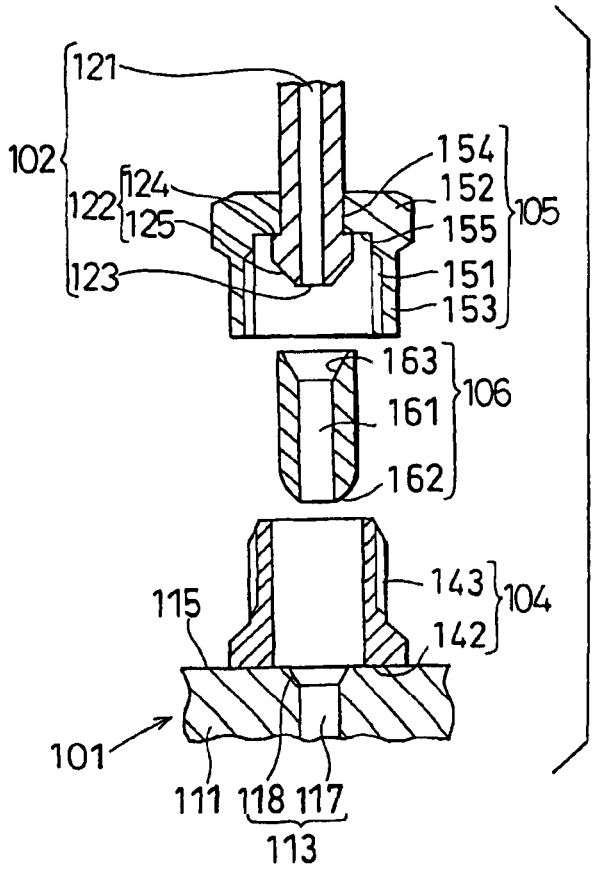
FIG. 10B is a longitudinal cross-sectional view showing a pipe connector in a state before connecting the fuel pipe to the common rail according to the fourth embodiment.

Next, a common rail type fuel injection system according to a fourth embodiment will be explained based on FIGS. 10A and 10B. In a common rail 101 of the fourth embodiment, a sleeve nut 105 is used as a pipe connector. Furthermore, the common rail 101 and the fuel pipe 102 are connected via an intermediate connecting member 106.

In the common rail 101 according to the fourth embodiment, the sleeve 104 has a male screw 143 at its outer peripheral surface instead of the female screw 141 at its inner peripheral surface. The male screw 143 is a fastened portion, which is fastened with a female screw 151 of the sleeve nut 105 when the fuel pipe 102 is connected to the common rail 101.

The sleeve nut 105 includes a head portion 152 in the shape of a hexagonal pillar and a sleeve portion 153 formed with a female screw 151 at its inner peripheral surface. Like an ordinary hexagonal nut, a spanner or the like is fitted to the head portion 152 and the head portion 152 is rotated to fasten the sleeve nut 105. The female screw 151 is a fastening portion, which is fastened with the male screw 143 of the sleeve 104 when the fuel pipe 102 is connected to the common rail 101. A spanner or the like is fitted to the head portion 152 and the head portion 152 is rotated to fasten the female screw 151 of the sleeve nut 105 to the male screw 143 of the sleeve 104. An insertion hole 154 is formed inside the head portion 152. The fuel pipe 102 is inserted to the insertion hole 154 so that the fuel pipe 102 penetrates the head portion 152 in an axial direction of the sleeve nut 105. The fuel pipe 102 is previously inserted into the insertion hole 154 in a direction in which an inner surface 155 of the head portion 152 in the sleeve 104 side can press the pressure receiving seat surface 124 of the connection head portion 122 of the fuel pipe 102.

The intermediate connecting member 106 is a cylindrical member, whose external diameter is smaller than the internal diameter of the sleeve 104. The intermediate connecting member 106 is accommodated in a hollow portion of the sleeve 104 when the fuel pipe 102 is connected to the common rail 101.

The intermediate connecting member 106 is formed with a hollow portion, which provides a fuel passage 161 through which the high-pressure fuel flows. An end of the intermediate connecting member 106 in the common rail 101 side constitutes a seal surface 162 formed substantially in a semispherical shape and is formed with an opening of the fuel passage 161. The seal surface 162 is pressed against the pressure receiving seat surface 118 of the common rail 101 when the fuel pipe 102 is connected to the common rail 101. Thus, the end of the intermediate connecting member 106 in the common rail 101 side is fitted to the pressure receiving seat surface 118 liquid-tightly. On the other hand, the other end of the intermediate connecting member 106 constitutes a pressure receiving seat surface 163, at which the internal diameter of the fuel passage 161 is enlarged outward in a conical shape. The seal surface 125 of the connection head portion 122 of the fuel pipe 102 is pressed against the pressure receiving seat surface 163 when the fuel pipe 102 is connected to the common rail 101. Thus, the connection head portion 122 is fitted to the pressure receiving seat surface 163 at the end of the intermediate connecting member 106 opposite from the common rail 101 liquid-tightly.

Thus, an effect similar to that of the third embodiment can be achieved.

(Fifth Embodiment)

Figure 11A:
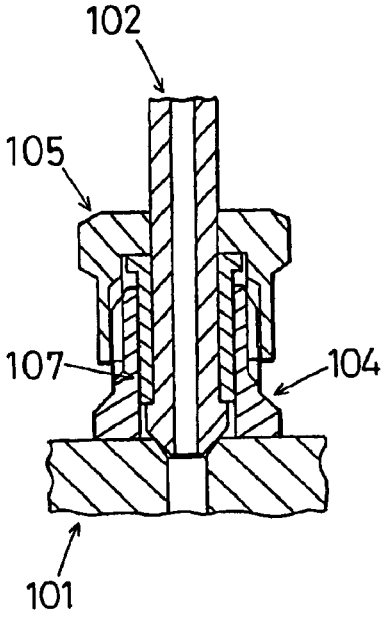
FIG. 11A is a longitudinal cross-sectional view showing a pipe connector in a state after connecting a fuel pipe to a common rail according to a fifth embodiment of the present invention.
Figure 11B:
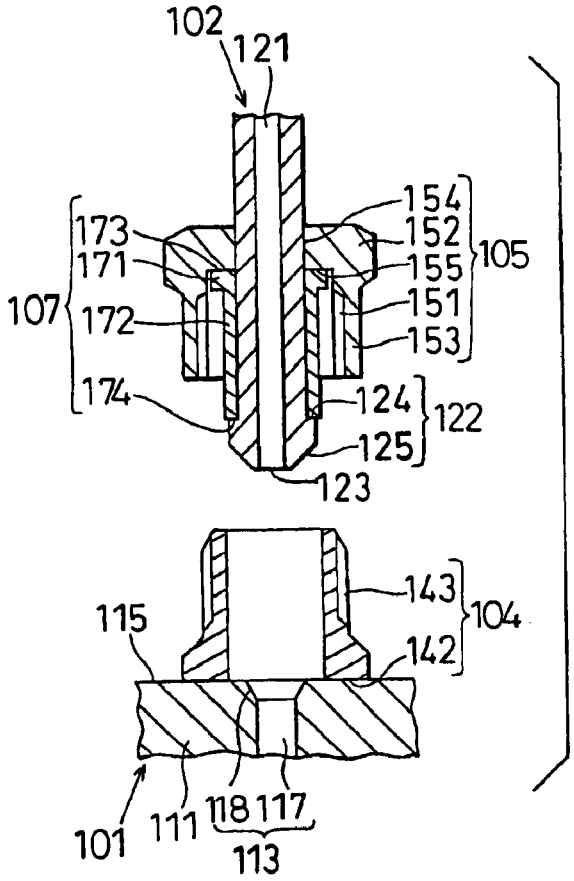
FIG. 11B is a longitudinal cross-sectional view showing a pipe connector in a state before connecting the fuel pipe to the common rail according to the fifth embodiment.
Figure 12:
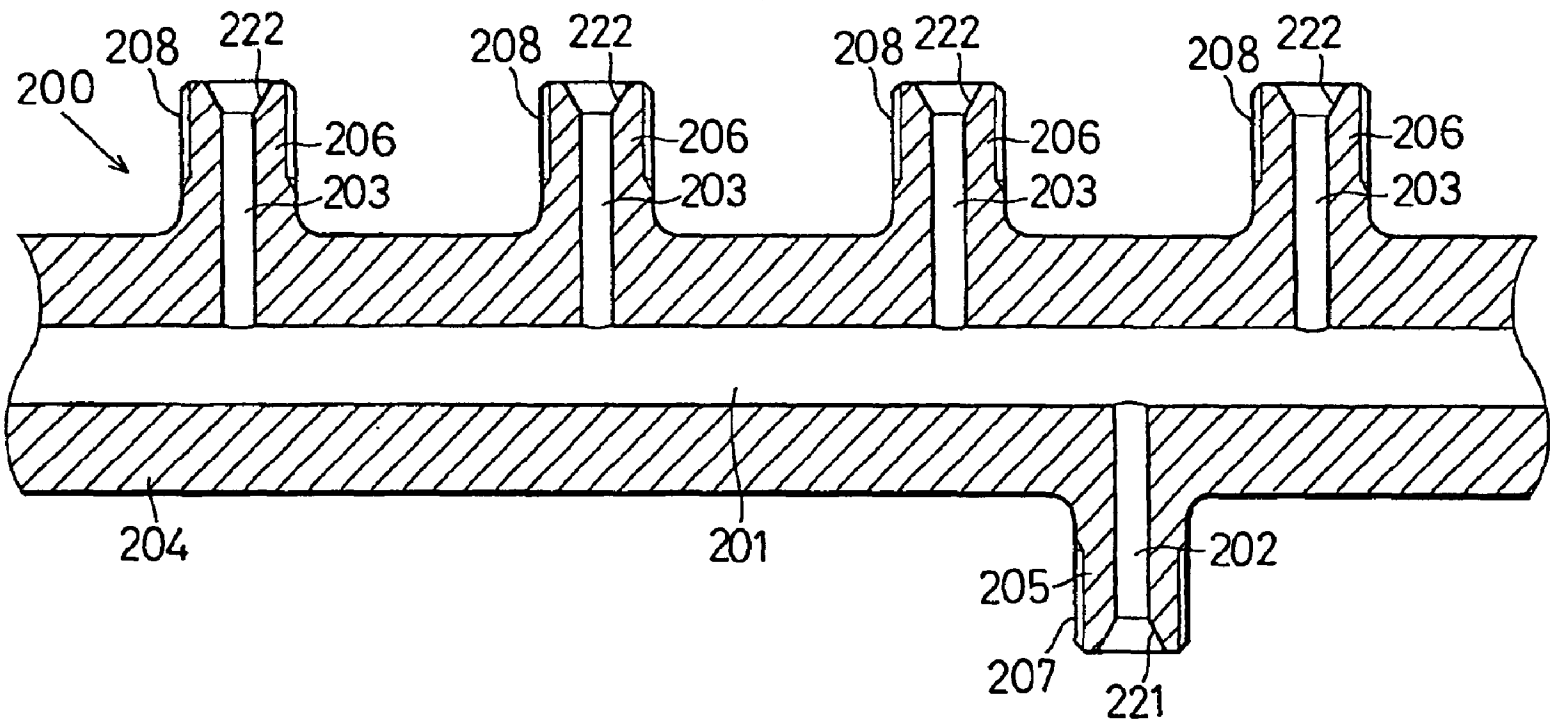
FIG. 12 RELATED ART
FIG. 12 is a longitudinal cross-sectional view showing a common rail in which pipe connectors are integrated with an accumulator main body in a related art.
Figure 13:
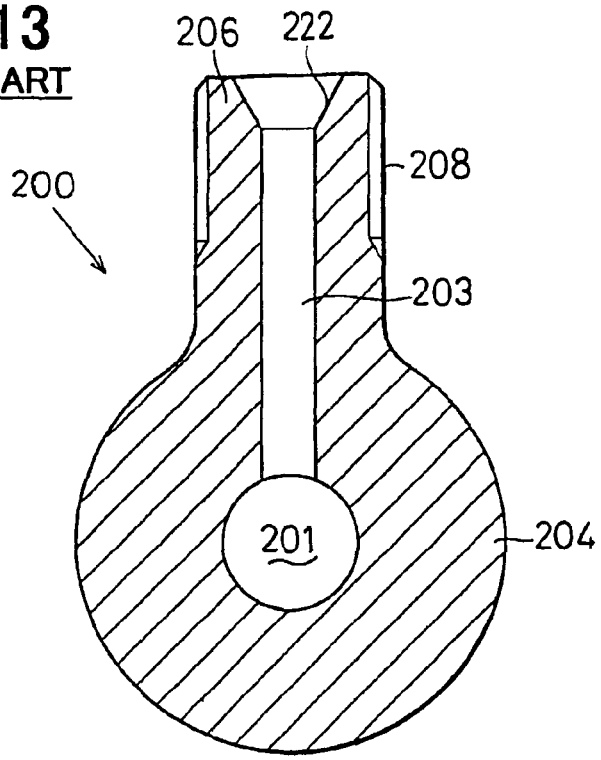
FIG. 13 RELATED ART
FIG. 13 is a cross-sectional view showing the common rail in which the pipe connector is integrated with the accumulator main body in the related art.
Figure 14A:
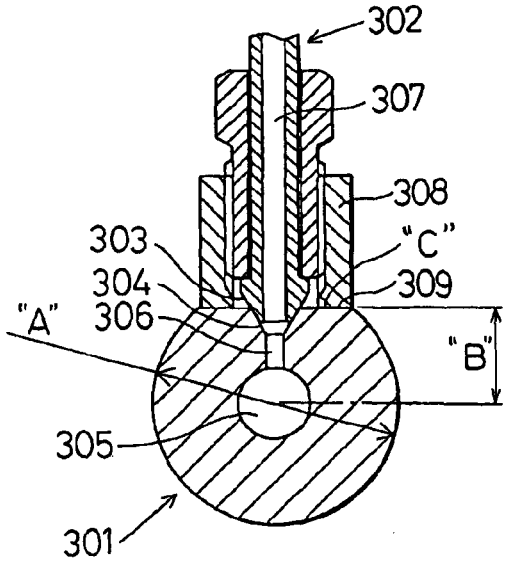
FIG. 14A RELATED ART
FIG. 14A is a cross-sectional view showing a common rail connected with a fuel pipe by fastening a bolt and a sleeve in another related art.
Figure 14B:
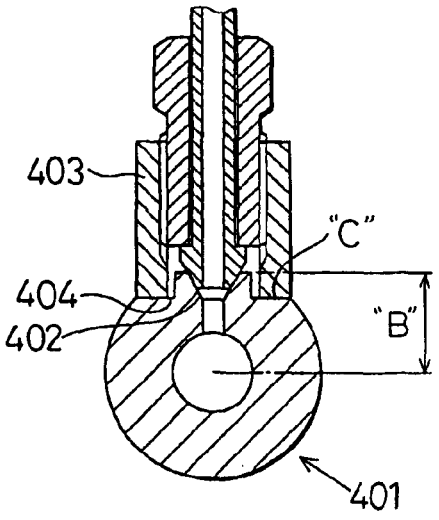
FIG. 14B RELATED ART
FIG. 14B is a cross-sectional view showing a common rail connected with a fuel pipe by fastening a bolt and a sleeve in yet another related art.

Next, a common rail type fuel injection system according to a fifth embodiment will be explained based on FIGS. 11A and 11B. In a common rail 101 of the fifth embodiment, a sleeve nut 105 is used as the pipe connector. The sleeve nut 105 presses the fuel pipe 102 via an intermediate pressing member 107 to connect the fuel pipe 102 with the common rail 101.

The intermediate pressing member 107 includes a flange portion 171 in a flange-like shape and a sleeve portion 172 in a cylindrical shape. An end of the intermediate pressing member 107 in the flange portion 171 side constitutes a pressure receiving seat surface 173. The pressure receiving seat surface 173 is pressed by an inner surface 155 of the sleeve nut 105 in a sleeve 104 side when the fuel pipe 102 is connected to the common rail 101. The other end of the intermediate pressing member 107 in the sleeve portion 172 side constitutes a pressing portion for pressing the pressure receiving seat surface 124 of the connection head portion 122 of the fuel pipe 102.

An external diameter of the flange portion 171 is smaller than an internal diameter of the sleeve side inner surface 155. The flange portion 171 is previously accommodated in a hollow of a sleeve portion 153 of the sleeve nut 105 so that the sleeve side inner surface 155 can press the pressure receiving seat surface 173. The intermediate pressing member 107 is formed with a hollow portion in the shape of a cylinder so that the hollow portion penetrates the flange portion 171 and the sleeve portion 172 in an axial direction of the intermediate pressing member 107. The fuel pipe 102 is inserted to the hollow portion of the intermediate pressing member 107. The fuel pipe 102 is previously inserted to the hollow portion of the intermediate pressing member 107 so that the pressing portion 174 of the intermediate pressing member 107 can press the pressure receiving seat surface 124 of the connection head portion 122.

Thus, an effect similar to that of the third embodiment can be achieved.

(Modifications)

In the embodiments, the cross section of the outer peripheral surface of the peripheral wall portion 21, 111 of the common rail 1, 101 is formed in the shape of a complete round with the forged product or the press-molded product made of a low-hardness material such as low carbon steel. Alternatively, the cross section of the outer peripheral surface of the peripheral wall portion 21, 111 may be formed in an elliptical shape or an oval shape.

In the first and second embodiments, the plurality of pipe connectors are constituted respectively with the plurality of connector main bodies 2, 3 and the plurality of nuts 6, 7 or with the plurality of connector main bodies 4, 5 and the plurality of sleeves 8, 9. Alternatively, each pipe connector may be constituted only with a fastening member formed in the shape of a nipple. In this case, the high-pressure pipes are inserted through holes formed in the fastening members so that the high-pressure pipes penetrate the holes, and the fastening members are fastened to the respective fastening portions 33, 34 formed at inner peripheries of the plurality of pipe connecting portions 25, 26 of the common rail 1.

In the first and second embodiments, an example of applying the present invention to a structure of assembling the pipe connector for connecting the connection head portion 11*a* of the high-pressure pipe 11 in the supply pump side or the connection head portion 12*a* of the high-pressure pipe 12 in the injector side with the common rail 1 liquid-tightly. Alternatively, the invention may be applied to a structure of assembling a pipe connector for connecting attachments of the common rail 1 such as the pressure limiter, the pressure reducing regulation valve with the common rail 1 liquid-tightly.

Furthermore, the pipe connector for connecting the high-pressure pipe 11 in the supply pump side to the common rail 1 may be constituted with a fastening member formed in the shape of a nipple, which has a fastening portion and a fastened portion with a screw shape in both sides of a hexagonal portion, and the fastening member may be connected to one of the ends of the common rail 1. In this case, the fastened portion of the fastening member is screwed with a fastening portion in the shape of a female screw provided at the end of the accumulation chamber 22 of the common rail 1, and the fastening portion of the fastening member is screwed with a nut 6 holing the high-pressure pipe 11.

In the first embodiment, the fastened portions 42 formed in the shape of a male screw at the outer peripheries of the connector main bodies 2, 3 are fastened to the fastening portions 33, 34 formed in the shape of a female screw at the inner peripheries of the pipe connecting portions 25, 26 of the common rail 1. Thus, the connector main bodies 2, 3 are fastened to the pipe connecting portions 25, 26. Then, the nut fastened portions 53 formed in the shape of a female screw at the inner peripheries of the respective nuts 6, 7 holding the connection head portions 11*a*, 12*a* of the respective high-pressure pipes 11, 12 are fastened to the nut fastening portions 43 formed in the shape of a male screw at the outer peripheries of the connector main bodies 2, 3. Thus, the nuts 6, 7 are fastened to the connector main bodies 2, 3. Alternatively, the connector main bodies 2, 3 may be fastened to the pipe connecting portions 25, 26 by screwing the fastened portions 42 of the connector main bodies 2, 3 to the fastening portions 33, 34 of the common rail 1 after fastening the nuts 6, 7, which is holding the connection head portions 11*a*, 12*a*, to the connector main bodies 2, 3 by screwing the nut fastened portions 53 to the nut fastening portions 43.

In the third, fourth and fifth embodiments, a screwing type assembling structure for fastening a male screw to a female screw is employed. Alternatively, a flange type assembling structure may be employed. In the flange type assembling structure, a flange is provided at an outer peripheral surface of the sleeve 104. The flange is bonded with another flange provided at the fuel pipe 102 or at a pipe connector provided separately from the fuel pipe 102 with butt bolts and nuts through a packing member or the like. Alternatively, a flare type assembling structure may be employed. In the flare type assembling structure, a conical portion (a flared portion) is formed by widening an end of the sleeve 104 opposite from the bonding surface between the sleeve 104 and the common rail 101. Then, the flare portion is bonded to a conical portion provided at the fuel pipe 102 or at a pipe connector provided separately from the fuel pipe 102. In the flare type assembling structure, a screwing type fastening structure in which a male screw formed at the fuel pipe 102 or at a pipe connector separate from the fuel pipe 102 is screwed with a female screw formed at an inner peripheral portion of the flare portion may be employed. Alternatively, in the flare type assembling structure, a flange type fastening structure in which a flange provided at the fuel pipe 102 or at a pipe connector separate from the fuel pipe 102 is bonded to another flange provided at an outer peripheral portion of the flare portion with butt bolts and nuts via a packing member or the like may be employed.

In the third embodiment, the bolt 103 separate from the fuel pipe 102 is used, and the male screw 132 of the bolt 103 is fastened to the female screw 141 of the sleeve 104. Alternatively, a male screw (fastening portion) may be provided at the fuel pipe 102 and fastened to the female screw 141 (fastened portion).

In the fourth and fifth embodiments, the intermediate connecting member 106 or the intermediate pressing member 107 is used for connecting the common rail 101 with the fuel pipe 102 liquid-tightly. Alternatively, a flange portion in the shape of a flange separate from the connection head portion 122 may be provided at an outer peripheral portion of the fuel pipe 102, and the sleeve side inner surface 155 of the sleeve nut 105 may press the flange portion toward the common rail 101.

In the third, fourth and fifth embodiments, the bolt head portion 131 of the bolt 103 and the head portion 152 of the sleeve nut 105 are constituted with the hexagonal heads. Alternatively, each head portion may be constituted with a square head, a round head, a pan head, a flat head, a round flat head, a dish head, a round dish head or the like.

In the third, fourth and fifth embodiments, the flat surface 115 is produced by machining the outer periphery of the thick wall portion 116 uniformly into the flat surface. Alternatively, the outer periphery of the thick wall portion 116 may be partially cut off to form flat surfaces. For instance, the peripheral surface of the thick wall portion 116 may be partially cut off into the flat surfaces only at portions where the bonding surfaces 142 of the sleeves 104 are bonded to the common rail 101.

In the third and fifth embodiments, the connection head portion 122 in the conical shape is fitted to the pressure receiving seat surface 118 provided at the conical portion of the communication hole 113 liquid-tightly. Alternatively, the connection head portion 122 may be constituted with a flange portion in a flange-like shape and an end surface of the flange portion in the common rail 101 side may adhere to the flat surface 115 of the common rail 101 liquid-tightly as the seal surface 125. In this case, a packing member may be inserted between the end surface of the flange portion in the common rail 101 side and the flat surface 115, and the conical portion may not be provided at the insertion hole 113 of the common rail 101.

In the fourth embodiment, the connection head portion 122 in the conical shape is fitted to the cone-shaped pressure receiving seat surface 163 of the intermediate connecting member 106 liquid-tightly. Alternatively, the connection head portion 122 may be constituted with a flange portion in the shape of a flange, and the end of the intermediate connecting member 106 in the fuel pipe side may be machined into a flat surface so that the flange portion of the connection head portion 122 adheres to the end of the intermediate connecting member 106 liquid-tightly. In this case, a packing member may be inserted between the flange portion of the connection head portion 122 and the end of the intermediate connecting member 106 in the fuel pipe side. Alternatively, the end of the intermediate connecting member 106 in the fuel pipe side may be constituted with a flange portion in the shape of a flange, and the end of the fuel pipe 102 in the intermediate connecting member 106 side may be machined into a flat surface by cutting off the connection head portion 122 so that the flange portion of the intermediate connecting member 106 adheres to the end of the fuel pipe 102 liquid-tightly. In this case, a packing member may be inserted between the flange portion of the intermediate connecting member 106 and the end of the fuel pipe 102 in the intermediate connecting member 106 side.

In the fourth embodiment, the substantially hemisphere-shaped seal surface 162 of the intermediate connecting member 106 is fitted to the pressure receiving seat surface 118 liquid-tightly. Alternatively, the end of the intermediate connecting member 106 in the common rail 101 side may be constituted with a flange portion in the shape of a flange so that the flange portion adheres to the flat surface 115 of the common rail 101 liquid-tightly. In this case, a packing member may be inserted between the flange portion of the intermediate connecting member 106 and the flat surface 115.

In the third, fourth and fifth embodiments, arc welding is used in bonding the bonding surface 142 of the sleeve 104 to the flat surface 115 of the common rail 101. Alternatively, high-temperature pressure welding may be employed. In the high-temperature pressure welding, the bonding surface 142 is pressure-welded to the flat surface 115 by heating a bonded portion of the flat surface 115 or the bonding surface 142 to a vicinity of a melting point. Alternatively, brazing or soldering for bonding the bonding surface 142 to the flat surface 115 by melting and adding a metal having a melting point lower than that of the base materials (flat surface 115 of the common rail 101 and the bonding surface 142 of the sleeve 104).

The present invention should not be limited to the disclosed embodiments, but may be implemented in many other ways without departing from the spirit of the invention.

What is claimed is:

1. An accumulation type fuel injection system comprising:

a plurality of fuel pipes, the each fuel pipe being formed with a fuel passage therein and a connection head portion at an end thereof;

a common rail having a peripheral wall portion, which has an outer peripheral surface whose cross section is formed substantially in the shape of a round and provides an accumulation chamber therein from one end to the other end of the common rail in an axial direction of the common rail, the accumulation chamber communicating with the fuel passages of the fuel pipes; and a plurality of pipe connectors fastened to pipe connecting portions formed on the peripheral wall portion of the common rail for holding the connection head portions of the fuel pipes and for connecting the connection head portions of the fuel pipes to the common rail respectively, wherein the accumulation chamber is formed so that a central axis thereof is deviated from a central axis of the common rail to form a thick wall portion in the peripheral wall portion, the thick wall portion having a thicker wall than other portions of the peripheral wall portion, the pipe connecting portions are formed at the thick wall portion of the peripheral wall portion, the pipe connectors are screwed to the common rail at the pipe connecting portions, and wherein the pipe connector includes:

a connector main body formed substantially in the shape of a circular pipe, which is fastened to an inner periphery of the pipe connecting portion to make an adhesion surface of the pipe connector adhere to a pressure receiving seat surface of the pipe connecting portion with a predetermined fastening axial force, and a nut fastened to an outer periphery of the connector main body to make an adhesion surface of the connection head portion of the fuel pipe adhere to a pressure receiving seat surface of the connector main body with a predetermined fastening axial force.

2. The accumulation type fuel injection system as in claim 1, wherein;

the pipe connecting portions are formed in the thick wall portion of the peripheral wall portion along an axial direction of the common rail at predetermined intervals, the common rail is formed with a fuel supply hole in one of the pipe connecting portions for introducing high-pressure fuel discharged from a fuel supply pump into the accumulation chamber and with a plurality of fuel branch holes in the other pipe connecting portions for distributing the fuel accumulated in the accumulation chamber to fuel injection valves of respective cylinders of an internal combustion engine, the common rail is formed with a plurality of fitting holes for fitting the pipe connectors respectively outside the fuel supply hole and the fuel branch holes in a radial direction of the common rail, and the pipe connecting portions are formed outside the plurality of fitting holes in the radial direction of the common rail.

3. The accumulation type fuel injection system as in claim 1, wherein the pipe connector is formed with a fuel passage hole for connecting the fuel passage formed in the fuel pipe with the accumulation chamber, and is formed with a fixed restrictor in the fuel passage hole.

4. An accumulation type fuel injection system comprising:

a plurality of fuel pipes, each fuel pipe being formed with a fuel passage therein and a connection head portion at an end thereof;

a common rail having a peripheral wall portion, which has an outer peripheral surface whose cross section is formed substantially in the shape of a circle and provides an accumulation chamber therein from one end to the other end of the common rail in an axial direction of the common rail, the accumulation chamber communicating with the fuel passages of the fuel pipes; and a plurality of pipe connectors fastened to pipe connecting portions formed on the peripheral wall portion of the common rail for holding the connection head portions of the fuel pipes and for connecting the connection head portions of the fuel pipes to the common rail respectively, wherein the accumulation chamber is formed so that a central axis thereof is deviated from a central axis of the common rail to form a thick wall portion in the peripheral wall portion, the thick wall portion having a thicker wall than other portions of the peripheral wall portion, the pipe connecting portions are formed at the thick wall portion of the peripheral wall portion, the pipe connecting portions are continuous or separate flat surfaces, and the pipe connectors are bonded to the common rail at the pipe connecting portions.

5. An accumulation type fuel injection system comprising:

a plurality of fuel pipes, the each fuel pipe being formed with a fuel passage therein and a connection head portion at an end thereof;

a common rail having a peripheral wall portion, which has an outer peripheral surface whose cross section is formed substantially in the shape of a round and provides an accumulation chamber therein from one end to the other end of the common rail in an axial direction of the common rail, the accumulation chamber communicating with the fuel passages of the fuel pipes; and a plurality of pipe connectors fastened to pipe connecting portions formed on the peripheral wall portion of the common rail for holding the connection head portions of the fuel pipes and for connecting the connection head portions of the fuel pipes to the common rail respectively, wherein the accumulation chamber is formed so that a central axis thereof is deviated from a central axis of the common rail to form a thick wall portion in the peripheral wall portion, the thick wall portion having a thicker wall than other portions of the peripheral wall portion, the pipe connecting portions are formed at the thick wall portion of the peripheral wall portion, the pipe connectors are screwed to the common rail at the pipe connecting portions, and the pipe connector includes a connector main body formed substantially in the shape of a circular cylinder, which is fastened to an inner periphery of the pipe connecting portion, and a sleeve formed substantially in the shape of a circular cylinder, which is fitted into the connector main body for making an adhesion surface of the connection head portion of the fuel pipe adhere to a pressure receiving seat surface of the pipe connecting portion with a predetermined fastening axial force.

6. The accumulation type fuel injection system as in claim 4, wherein each pipe connector is constituted with a sleeve formed in the shape of a cylinder with a bonding surface on one end thereof, the bonding surface being bonded to the pipe connecting portion of the common rail.

7. An accumulation type fuel injection system comprising:

a plurality of fuel pipes, the each fuel pipe being formed with a fuel passage therein and a connection head portion at an end thereof;

a common rail having a peripheral wall portion, which has an outer peripheral surface whose cross section is formed substantially in the shape of a round and provides an accumulation chamber therein from one end to the other end of the common rail in an axial direction of the common rail, the accumulation chamber communicating with the fuel passages of the fuel pipes; and a plurality of pipe connectors fastened to pipe connecting portions formed on the peripheral wall portion of the common rail for holding the connection head portions of the fuel pipes and for connecting the connection head portions of the fuel pipes to the common rail respectively, wherein the accumulation chamber is formed so that a central axis thereof is deviated from a central axis of the common rail to form a thick wall portion in the peripheral wall portion, the thick wall portion having a thicker wall than other portions of the peripheral wall portion, the pipe connecting portions are formed at the thick wall portion of the peripheral wall portion, the pipe connecting portions are continuous or separate flat surfaces, the pipe connectors are bonded to the common rail at the pipe connecting portions, each pipe connector is constituted with a sleeve formed in the shape of a cylinder with a bonding surface on one end thereof, the bonding surface being bonded to the pipe connecting portion of the common rail, the sleeve is provided with a fastened portion, which is fastened to a fastening portion formed on the fuel pipe, and the connection head portion of the fuel pipe is connected to the common rail by fastening the fastening portion of the fuel pipe to the fastened portion of the sleeve.

8. An accumulation type fuel injection system comprising:

a plurality of fuel pipes, the each fuel pipe being formed with a fuel passage therein and a connection head portion at an end thereof;

a common rail having a peripheral wall portion, which has an outer peripheral surface whose cross section is formed substantially in the shape of a round and provides an accumulation chamber therein from one end to the other end of the common rail in an axial direction of the common rail, the accumulation chamber communicating with the fuel passages of the fuel pipes; and a plurality of pipe connectors fastened to pipe connecting portions formed on the peripheral wall portion of the common rail for holding the connection head portions of the fuel pipes and for connecting the connection head portions of the fuel pipes to the common rail respectively, wherein the accumulation chamber is formed so that a central axis thereof is deviated from a central axis of the common rail to form a thick wall portion in the peripheral wall portion, the thick wall portion having a thicker wall than other portions of the peripheral wall portion, the pipe connecting portions are formed at the thick wall portion of the peripheral wall portion, the pipe connecting portions are continuous or separate flat surfaces, the pipe connectors are bonded to the common rail at the pipe connecting portions, each pipe connector is constituted with a sleeve formed in the shape of a cylinder with a bonding surface on one end thereof, the bonding surface being bonded to the pipe connecting portion of the common rail, the sleeve is provided with a fastened portion, which is fastened to a fastening portion formed on the pipe connector formed separately from the fuel pipe, and the connection head portion of the fuel pipe is connected to the common rail by fastening the fastening portion of the pipe connector to the fastened portion of the sleeve.

9. The accumulation type fuel injection system as in claim 5, wherein;

the pipe connecting portions are formed in the thick wall portion of the peripheral wall portion along an axial direction of the common rail at predetermined intervals, the common rail is formed with a fuel supply hole in one of the pipe connecting portions for introducing high-pressure fuel discharged from a fuel supply pump into the accumulation chamber and with a plurality of fuel branch holes in the other pipe connecting portions for distributing the fuel accumulated in the accumulation chamber to fuel injection valves of respective cylinders of an internal combustion engine, the common rail is formed with a plurality of fitting holes for fitting the pipe connectors respectively outside the fuel supply hole and the fuel branch holes in a radial direction of the common rail, and the pipe connecting portions are formed outside the plurality of fitting holes in the radial direction of the common rail.

* * * * *